US006575567B2

(12) United States Patent
Matsumoto et al.

(10) Patent No.: US 6,575,567 B2
(45) Date of Patent: Jun. 10, 2003

(54) LIQUID DELIVERY SYSTEM, LIQUID CONTAINER, AND HEAD CARTRIDGE

(75) Inventors: Hidehisa Matsumoto, Kawasaki (JP); Hiroyuki Ishinaga, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/470,208

(22) Filed: Dec. 22, 1999

(65) Prior Publication Data

US 2002/0105564 A1 Aug. 8, 2002

(30) Foreign Application Priority Data

Dec. 24, 1998 (JP) ..... 10-368063

(51) Int. Cl.[7] ..... B41J 2/175
(52) U.S. Cl. ..... 347/85
(58) Field of Search ..... 347/85, 86, 87

(56) References Cited

U.S. PATENT DOCUMENTS

| | | | | | |
|---|---|---|---|---|---|
| 4,500,895 | A | * | 2/1985 | Buck et al. | 347/87 |
| 5,156,472 | A | * | 10/1992 | Suzuki et al. | 347/86 X |
| 5,701,995 | A | * | 12/1997 | Higuma et al. | 206/205 |
| 5,742,311 | A | * | 4/1998 | Koitabashi et al. | 347/86 |
| 5,784,088 | A | * | 7/1998 | Ujita et al. | 347/87 X |
| 6,010,213 | A | * | 1/2000 | Kanaya et al. | 347/87 |
| 6,179,415 | B1 | * | 1/2001 | Okazaki et al. | 347/86 |
| 6,345,888 | B1 | * | 2/2002 | Matsumoto et al. | 347/86 |
| 6,422,674 | B1 | * | 7/2002 | Hinami et al. | 347/7 |
| 6,460,984 | B1 | * | 10/2002 | Matsumoto et al. | 347/86 |

FOREIGN PATENT DOCUMENTS

| | | | | |
|---|---|---|---|---|
| EP | 580433 | | 1/1994 | |
| EP | 738605 | | 10/1996 | |
| EP | 0 738 605 | A2 * | 10/1996 | ..... B41J/2/175 |
| EP | 739741 | | 10/1996 | |
| EP | 803364 | | 10/1997 | |
| EP | 829365 | | 3/1998 | |
| EP | 925935 | | 6/1999 | |
| JP | 7-068776 | * | 3/1995 | |
| JP | 8-34122 | | 2/1996 | |
| JP | 10-175311 | | 6/1998 | |

* cited by examiner

*Primary Examiner*—Michael Nghiem
(74) *Attorney, Agent, or Firm*—Fitzpatrick, Cella, Harper & Scinto

(57) ABSTRACT

A liquid supplying system using a negative pressure producing member accommodating chamber including a liquid supply portion for supplying liquid to outside, an air vent for fluid communication with ambience and a negative pressure producing member accommodating chamber for accommodating a negative pressure producing member for retaining the liquid therein, and using a liquid accommodating container which is detachably mountable to said negative pressure producing member accommodating chamber and which defines a substantially hermetically sealed space except for fluid communication with said negative pressure producing member accommodating chamber, the improvement residing in: an air introducing groove, provided at a connecting portion relative to said negative pressure producing member accommodating container in said liquid accommodating container, for gas-liquid exchange for permitting introduction of the gas into the liquid containing portion and discharge of the liquid.

13 Claims, 21 Drawing Sheets

(a)

(b)

LIQUID DELIVERY SYSTEM, LIQUID CONTAINER, AND HEAD CARTRIDGE

FIELD OF THE INVENTION AND RELATED ART

The present invention relates to a liquid delivery system which uses negative pressure to deliver liquid out of a liquid container, more specifically, a liquid delivery system for delivering liquid to a liquid jet recording apparatus which records images on recording medium. It also relates to a replaceable liquid container for the liquid delivery system, and a head cartridge.

There are a number of liquid delivery methods which use negative pressure to deliver liquid out of a liquid container. In the field of an ink jet recording apparatus, for example, an ink container which provides an ink jet recording head with negative pressure has been proposed, and has been put to practical use, in the form of an ink jet cartridge which integrally comprises a recording head and a negative pressure providing ink container. There are a number of ink jet cartridges, which can be classified into two groups: those which cannot be separated into a recording head and an ink container (ink storing portion), and those which can be separated into a recording means and an ink storing portion. In the case of the latter group, they can be individually separated from a recording apparatus, but remain united when they are used for recording.

There are various methods for generating negative pressure in the aforementioned liquid delivery system, and the simplest one is to use the capillary force of porous material. An ink container used for such a method comprises a shell, and a piece of porous material such as sponge for storing ink. The shell is provided with an air vent through which the atmospheric air is taken into the ink storing portion of the ink container so that ink is smoothly delivered during a printing operation. It is preferable that the porous material is compressed into the shell to fill virtually the entirety of the internal space of the ink container.

However, the usage of porous material as ink holding material creates some problems. One such problem is that the filling of an ink container with porous material reduces the ratio of the amount of ink storable in an ink container to the internal space of the ink container. In order to solve this problem, the applicants of the present invention proposed an ink container, which is disclosed in EP0580433 (official gazette). According to this proposal, an ink container is provided with a virtually sealed ink reservoir, and a negative pressure holding chamber in which a negative pressure generating member is held. The internal spaces of the ink reservoir and negative pressure generating member holding chamber are connected through a passage, and the negative pressure generating member holding chamber is open to the atmosphere. The applicants of the present invention also disclosed another invention disclosed in EP081531 (official gazette). According to this invention, an ink reservoir is made replaceable.

In the case of the aforementioned ink container, the ink within the ink reservoir is delivered from the ink reservoir to the negative pressure generating member holding chamber, as the atmospheric air displaces the ink within the ink reservoir in response to the ink delivery from the ink reservoir. Thus, the aforementioned ink reservoir has merit in that the negative pressure is kept virtually constant while the ink is delivered during this gas-liquid exchange stage.

The applicants of the present invention also proposed a liquid storing container, which is disclosed in EP0738605

(official gazette). According to this proposal, a liquid storing container comprises an outer shell in the form of a virtually polygonal prism, and a liquid storing portion placed in the outer shell. This proposal is characterized in that the liquid storing portion is similar in shape to the outer shell, the outward surface of each of its walls being in contact with, or closely following, the inward surface of the correspondent wall of the outer shell; that the liquid storing portion is enabled to deform in response to the outward delivery of the liquid stored in the liquid storing portion; and that the thickness of the walls of the liquid storing portion is greater at its corner portions than at the center portions of the walls. The liquid storing portion of this liquid storing container contracts by a proper amount in response to the ink delivery therefrom (liquid in the ink storing portion is not displaced by gas), so that liquid can be delivered while maintaining a proper amount of negative pressure. Therefore, unlike a conventional ink storing member, which is in the form of a pouch, this liquid storing container does not have any restriction regarding its positioning. Thus, it can be mounted on a carriage. Further, ink is directly stored in the storing portion, which makes this invention superior also in terms of ink storage efficiency.

It should be noted here that, in the case of an ink container of such a type that comprises a negative pressure generating member holding chamber such as the one described above, and a matching ink reservoir which is placed adjacent to the negative pressure generating member holding chamber, and is provided with a predetermined amount of storage space, gas is introduced into the ink reservoir to displace the ink (gas-liquid exchange occurs) as the ink within the ink reservoir is delivered into the negative pressure generating member holding chamber.

In other words, as the ink in the ink reservoir is delivered to the negative pressure generating member holding chamber, the atmospheric air is introduced into the ink reservoir in response to the ink delivery, by an amount equal to the amount of the delivered ink. Therefore, the ink reservoir is occupied with both the introduced outside air, and ink. If the air in the ink reservoir is expanded by the changes (for example, daily temperature fluctuation) in the ambience in which the printer is used, the ink within the ink reservoir is sometimes forced into the negative pressure generating member holding chamber side by the expansion. For this reason, in the past, the ratio of the amount by which the ink is moved, to the air expansion, in various environments in which the recording apparatus is used, had to be taken into consideration to provide the negative pressure generating member with the maximum amount of buffering space, in terms of practical use. As a result, it was very difficult to provide an ink reservoir with an internal volume greater than a certain size.

In order to solve the above described problems, the inventors of the present invention analyzed in detail an ink container of such a type that comprised a negative pressure generating member holding chamber, and an ink reservoir matching the negative pressure generating member holding chamber, in the state in which the ink reservoir contained air. As a result, it was discovered that the delivery of the ink in the ink reservoir to the negative pressure generating member holding chamber is directly linked to the introduction of the outside air, and therefore, in order to solve the above described problem, the amount by which ink moves from the ink reservoir to the negative pressure generating member should be regulated.

Further analysis led the inventors to an idea that, although it is impossible to prevent the air present in the ink reservoir from expanding, it is possible to contain the effect of the expansion of the air in the ink reservoir, within the ink reservoir, which is contrary to the conventional concept.

SUMMARY OF THE INVENTION

The present invention was made as the result of further study of the aforementioned discovery and knowledge carried out by the inventors of the present invention.

An essential thought kept in the minds of the inventors of the present invention was in order to reliably deliver ink even immediately after the exchange of the ink reservoir, a structure for enhancing the introduction of atmospheric air, which effectively functions without being clogged by the adhesion of solidified ink or the like, should be provided.

The primary object of the present invention is to provide a liquid delivery system superior in terms of practicality, that is, a liquid delivery system, the ink reservoir (liquid storing container) of which is exchangeable, and is capable of reliably delivering ink while generating and maintaining a stable amount of negative pressure, and also to provide a liquid storing container usable in such a liquid delivery system.

Another object of the present invention is to provide various inventions related to a head cartridge or the like with which the aforementioned liquid delivery system is usable.

The specific means in the present invention for accomplishing the above described objects will be become apparent from the understanding of the structures described below.

According to a characteristic aspect of the present invention, the liquid delivery system comprises: a negative pressure generating member holding chamber, which is provided with a liquid delivery portion for outward ink delivery, and an air vent portion, and stores therein a negative pressure generating member for retaining liquid therein; and a liquid storing container, which is exchangeably connectable to the negative pressure generating member holding chamber, and forms a virtually sealed space except for the joint portion by which it is connected to the negative pressure generating member holding chamber, wherein the liquid storing container to be connected to the negative pressure generating member holding container is provided with an atmospheric air introduction groove which is for displacing the liquid delivered from the liquid storing container, with the gas, by introducing gas into the liquid reservoir, and which is located at the joint portion of the ink reservoir, by which the ink reservoir is connected to the negative pressure generating member holding container.

According to another characteristic aspect of the present invention, a liquid storing container, which is exchangeably connectable to a negative pressure generating member holding chamber which is provided with a liquid delivery portion for outward ink delivery and an air vent portion, and stores therein a negative pressure generating member for retaining liquid therein, forms a virtually sealed space except for the joint portion by which it is connected to the negative pressure generating member holding chamber, and stores liquid, is provided with an atmospheric air introduction groove which is for displacing the liquid delivered from the liquid storing container, with the gas, by introducing gas into the liquid reservoir, and which is located at the joint portion of the ink reservoir, by which the ink reservoir is connected to the negative pressure generating member holding container.

According to the above described liquid delivery system and liquid storing container, the atmospheric air introduction groove is replaced as the liquid reservoir is replaced. Therefore, the atmospheric air introduction groove does not malfunction, making it possible to provide a liquid delivery system capable of reliably delivering ink. Further, a portion of the liquid in the liquid storing portion can be moved into the negative pressure generating member storing container with the use of the capillary force of the negative pressure generating member at the time of the connection. Therefore, it is assured that the liquid within the liquid storing container is reliably delivered for usage, regardless of the state of liquid retention in the negative pressure generating member, at the joint portion, upon installation.

Further, according to another characteristic aspect of the prevent invention regarding the above described liquid delivery system and liquid storing container, the liquid storing container comprises a liquid storing portion which stores liquid and is capable of generating negative pressure by deforming in response to the liquid delivery therefrom, a shell for covering the liquid storing portion, and an air vent through which atmospheric air can be introduced between the shell and the liquid storing portion.

In the case of a structure comprising a liquid storing portion such as the one described above, the liquid storing portion is elastically deformable. Therefore, even if the air or the like introduced into the liquid storing portion expands in response to ambient changes, the effect of the expansion is cushioned by the elasticity of the liquid storing portion, which works in the direction to restore the liquid storing portion to the original shape.

The liquid delivery port of the liquid storing portion is desired to be sealed with a sealing member. This sealing member is desired to separate from the liquid delivery port after the connection of the liquid storing container to the negative pressure generating member holding container. The negative pressure generating member holding container holds the negative pressure generating member between the aforementioned atmospheric air introduction groove and air vent.

It is possible to provide the negative pressure generating member holding container with a groove which becomes integrated with the aforementioned atmospheric air introduction groove to allow gas-liquid exchange.

Further, according to another characteristic aspect of the present invention, a head cartridge is provided with a recording head portion which records images by ejecting the liquid delivered from the aforementioned negative pressure generating member holding container.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiments

Hereinafter, the details of the preferred embodiments of the present invention will be described based on the appended drawings.

In the following description of the preferred embodiments, the liquid used in the liquid delivery method and liquid delivery system in accordance with the present invention will be described as ink. However, liquid compatible with the present invention is not limited to ink, which is obvious. For example, it includes liquid used for processing recording medium in the field of ink jet recording, and the like.

(Embodiment 1)

Figure 1:
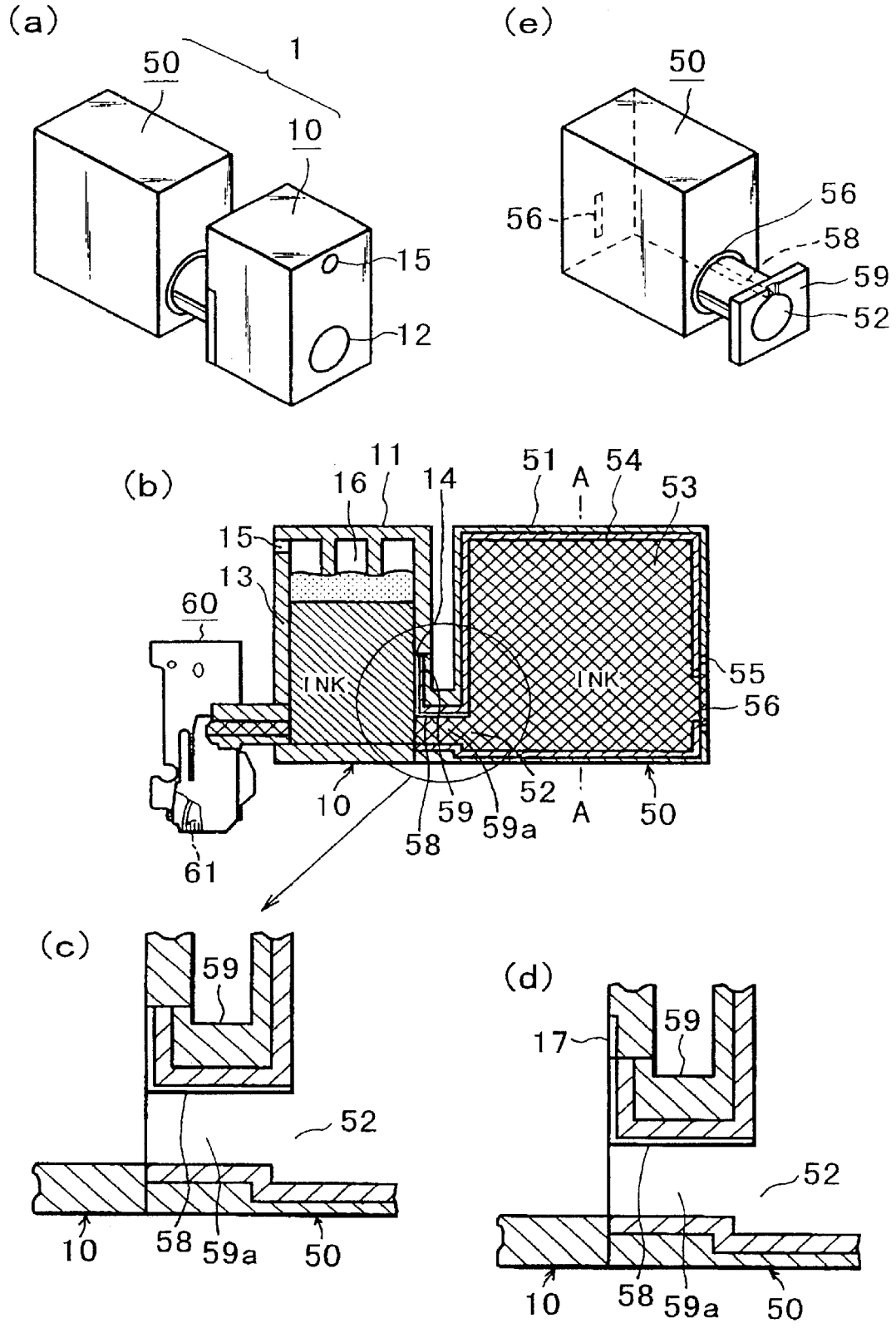
FIG. 1 is a schematic drawing for depicting the ink container in the first embodiment of the present invention, usable with a liquid delivery system in accordance with the present invention: (a) and (e) are perspective views; (b) is a sectional view; and (c), and (d) are enlarged sectional views.

FIG. 1 comprises schematic drawings for describing an ink container compatible with a liquid delivery system in accordance with the present invention: (a) is a perspective view of the ink container, and (b) is a sectional view of the ink container connected to a recording head.

An ink container 1 comprises a negative pressure generating member holding chamber 10, and an ink reservoir 50 which is separable from the negative pressure generating member holding chamber 10.

The negative pressure generating member holding chamber 10 comprises a shell 11 and a negative pressure generating member 13. The shell 11 is provided with an ink delivery port 12 through which ink (inclusive of recording medium processing liquid and the like) is delivered from the negative pressure generating member holding chamber 10 to a recording head portion 60 or the like which records images by ejecting liquid from a liquid ejection port. The negative pressure generating member 13 is formed of porous material such as polyurethane foam or the like, and is held in the shell 11. The shell 11 is also provided with an air passage 15 through which the negative pressure generating member 13 held in the shell 11 is exposed to the atmosphere. Adjacent to the air passage 15, there is a buffer portion 16 which comprises ribs projecting from the inward surface of the shell.

In comparison, the ink reservoir 50 comprises a shell 51 (outer shell) and a shell 54 (inner shell). The inner shell 54 is the same in shape as, or similar to, the outer shell 54, and perfectly conforms to the inward surface of the outer shell 51. The internal space of the inner shell 54 constitutes an ink storing portion 53 in which ink is stored. The ink reservoir 50 also comprises an ink delivery port 52 through which the liquid within the liquid storing portion 53 is delivered to the negative pressure generating member holding chamber 10. The inner shell 54 is flexible; in other words, the ink storing portion 53 is deformable in response to the ink delivery therefrom. Further, the inner shell 54 is provided with a portion 56 (pinch-off portion), which is welded to the outer shell 51 so that the inner shell 56 is fixed to the outer shell 51. The outer shell 51 is provided with an air vent 52 so that atmospheric air can be introduced into the space between the outer and inner shells 51 and 54.

The ink container is also provided with a gas-liquid exchange enhancing portion 59 comprising an atmospheric air introduction groove 53 for enhancing gas-liquid exchange, which will be described later, and a gas-liquid exchange passage 59*a*. The negative pressure generating member holding chamber 10 is provided with an interface portion 14, that is, an opening, with which the gas-liquid exchange enhancing portion 59 is fitted. In this embodiment, a portion of the atmospheric air introduction groove 58 and one of the end portions of the gas-liquid exchange passage 59*a* are connected to the negative pressure generating member 13, at the interface portion 14. The atmospheric air introduction groove 58 extends from the interface portion 14 to an ink delivery portion 52, so that liquid is smoothly delivered. This liquid delivery process will be described later.

Referring to FIG. 1, (*e*), which is a schematic perspective view of the ink container in this embodiment, the pinch-off portion 56 illustrated in FIG. 1, (*b*), is also provided on the other side, that is, the ink delivery side, of the ink container. An ink container structured so that the pinch-off portion 56 is provided on the side illustrated in FIG. 1, (*b*), as well as on the ink delivery side, as described above, is desirable because of the advantage that the aforementioned atmospheric air introduction groove 58 can be easily formed with the use of the pinch-off portion 56 on the ink delivery side. Also referring to FIG. 1, (*e*), which is a schematic perspective view of the ink container in this embodiment, the atmospheric air introduction groove 58 in this embodiment is extended upward from the center portion of the gas-liquid exchange enhancing portion 59. However, the position of the atmospheric air introduction groove 58 does not need to be limited to the one described above as long as the atmospheric air introduction groove 58 functions properly.

Next, referring to FIG. 1, (*d*), which is an enlarged view of the encircled portion of the FIG. 1, (*b*), the portion of the shell 11, which corresponds to the interface between the negative pressure generating member holding chamber 10 and ink reservoir 50, may be provided with a groove 17 which is integrated with the atmospheric air introduction groove 58 of the ink reservoir 50 which is removably connected to the negative pressure generating member holding chamber 10. In other words, when the negative pressure generating member holding chamber 10 side is provided with an air introduction groove for displacing the ink in the ink storing portion with air, the ink reservoir 50 side may be also provided with a groove which is integrated with the atmospheric air introduction groove on the negative pressure generating member holding chamber 10 side to displace the liquid in the ink storing portion with air.

In the appended sectional views of the ink containers in accordance with the present invention, inclusive of FIG. 1, the portions of the negative pressure generating member 13, in which ink is held, is hatched, and the ink in the spaces free of the negative pressure generating material, that is, the ink storing portion, atmospheric air introduction groove, or gas-liquid exchange passages, is represented by crosshatching.

The ink reservoir in this embodiment has six flat walls, being approximately in the form of a rectangular parallelepiped, and is provided with a cylindrical ink delivery port 52. The largest wall of this rectangular parallelepiped is indirectly illustrated in FIG. 1. The walls of the ink storing portion 53 are thinner at each of the corner portions, that is, the portions correspondent to the corner portions of the rectangular parallelepiped (hereinafter, corner portions inclusive of the cases in which corner portions are slightly rounded), than at the center portion of each wall; the thickness of each wall of the ink storing portion 53 gradually reduces from the center portion toward the corner portions, in such a way that the inward surface of each wall of the ink storing portion 53 slightly swells inward of the ink storing portion 53. In other words, the directions in which the walls of the ink storing portion 53 swell are the same as the directions in which the walls of the ink storing portion 53 deform, enhancing the deforming action of the walls, which will be described later.

Further, each corner portion of the inner shell is structured of three walls. Therefore, the overall strength of the corner portions of the inner shell is greater than that of the center portion of each wall. However, since each wall is thinner at the corner portions than across the center portion, it is allowed to flex. The three walls of the corner portion are desired to be approximately the same in thickness.

Because FIG. 1 is a schematic drawing, it looks as if there is a space between the walls of the outer shell 51 and the walls of the inner shell 54. However, the former and the latter may be in contact with each other as long as they are separable from each other. Obviously, there may be provided a microscopic space between them.

Next, referring to FIGS. 2–7, the liquid delivery action of the ink container illustrated in FIG. 1, which characterizes the present invention, will be described FIGS. 2–6 are schematic sectional drawings of the ink container illustrated in FIG. 1, the ink storing chamber of which is connected to the negative pressure generating member holding chamber, and the ink delivery port of the negative pressure generating member holding chamber of which is connected to the recording head 60, and depicts, in numerical order, the sequential changes which occur to the ink container as ink is delivered through the recording head 60. In each of FIGS.

2-6, (a) is a sectional view of the ink container at the same plane as that in FIG. 1, (*b*), and (b) is a sectional view of the liquid reservoir at a plane A—A in FIG. 1, (*b*). FIG. 7 is a graph which shows the relationship between the amount by which ink is delivered from the ink container, and the negative pressure at the ink delivery port portion. Its axis of abscissas represents the amount by which ink is delivered from the ink delivery port, and its axis of ordinates represents the negative (static) pressure at the ink delivery port portion. In FIG. 7, the changes in the negative pressure, which correspond to FIGS. 2–6, are indicated by the arrow marks.

Figure 2:
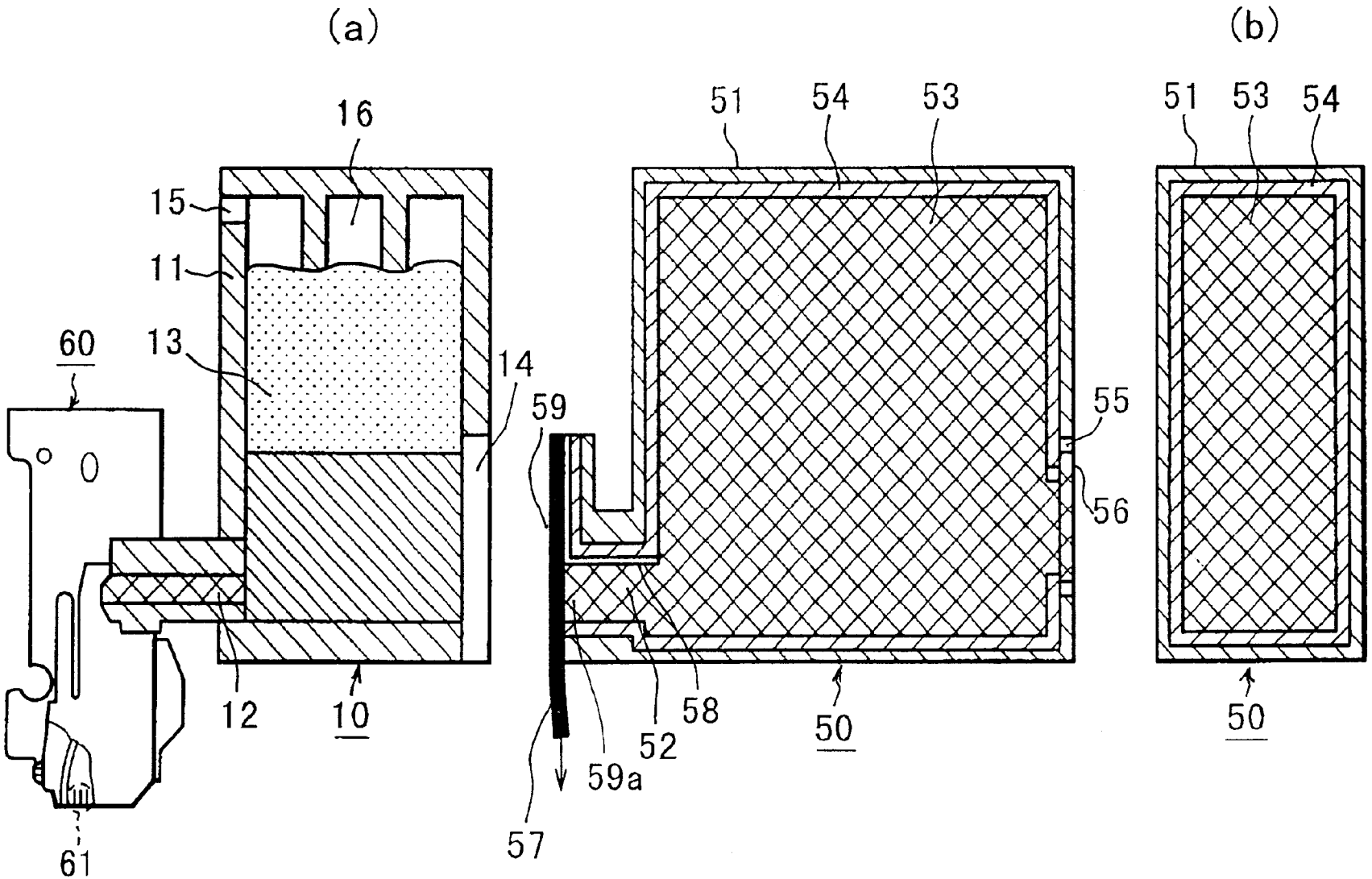
FIG. 2 is a schematic drawing for depicting how the ink reservoir and negative pressure generating member holding chamber of the ink container illustrated in FIG. 1 are connected to each other: (a) is a sectional view at the same plane as the one in FIG. 1, (*b*); and (b) is a sectional view of the liquid reservoir at a plane A—A in FIG. 1, (*b*).

FIGS. 2, (*a*) and (*b*), is a sectional drawing which shows the negative pressure generating member holding chamber and ink storing chamber prior to their connection.

Referring to FIGS. 2, (*a*) and (*b*), the ink delivery port 52 of the ink reservoir 50 is provided with a sealing member 57 for preventing the ink stored in the ink storing portion 53 from being released; the ink storing portion 53 of the ink reservoir 50 remains sealed from the atmospheric air. The inner shell 54, i.e., the wall of the ink storing portion 53, is configured so that its walls conform to the correspondent walls of the outer shell 51, or at least, the positions of its corner portions correspond, one for one, to the positions of the corners of the outer shell 51 (this state is called the initial state).

When the sealing member 57 is removed, ink sometimes leaks out due to external force, temperature change, and/or pressure change. This problem can be reliably prevented by filling the storing portion 53 with ink by an amount slightly less than its full capacity so that the ink delivery portion 52 is provided with a slight negative pressure when the sealing member 57 is removed.

Also in consideration of the aforementioned ambient changes, the amount of the air contained in the ink storing portion 53 prior to its connection to the negative pressure generating member holding chamber is desired to be as small as possible. As for a method to be used for reducing the amount of air which is introduced into the ink storing portion 53 during the liquid injection into the ink storing portion 53, there is a liquid injection method such as the one disclosed in Japanese Patent Application No. 200126/1997, for example.

In comparison, the negative pressure generating member 13 in the negative pressure generating member holding chamber 10 in FIG. 2, (*a*), contains ink in a certain portion of it.

The amount of the ink stored in the negative pressure generating member 13 depends upon the amount of the ink stored in the negative pressure generating member 13 during ink reservoir exchange, which will be described later. Therefore, some variation is permissible; it is not required that ink is uniformly retained in the negative pressure generating member 13 as depicted in the drawing.

Figure 3:
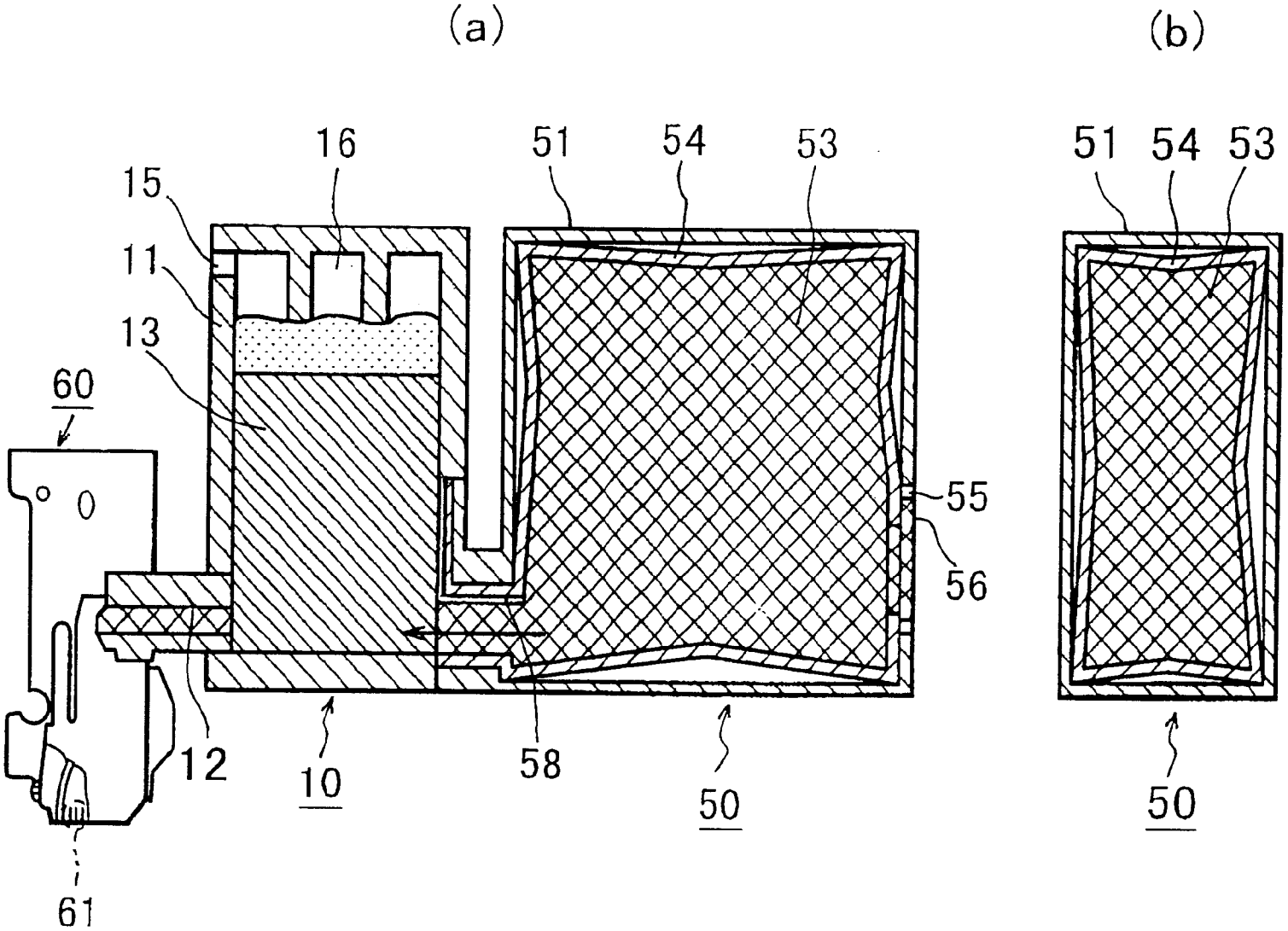
FIG. 3 is a sectional drawing for describing the state of the ink container illustrated in FIG. 1, immediately before the beginning of its first usage: (a) is a sectional view at the same plane as the one in the FIG. 1, (*b*), and (b) is a sectional view of the liquid reservoir at the plane A—A in FIG. 1, (*b*).

Next, referring to FIGS. 3, (*a*) and (*b*), the ink reservoir 50 is connected to the negative pressure generating member holding chamber 10. After their connection, the ink flows, as indicated by an arrow mark in FIG. 3, (*a*), until the internal pressures of the negative pressure generating member holding chamber 10 and ink reservoir 50 become equal, that is, equilibrium is realized. In this state, the ink delivery portion 12 is provided with negative pressure (this state is called ink delivery starting state).

At this time, the ink flow which causes the aforementioned equilibrium will be described in detail.

First, the gas-liquid exchange enhancing portion 59 is inserted into the interface portion 14 of the negative pressure generating member holding chamber 10, and the sealing member 57 is pulled out. As the sealing member 57 is pulled out, the atmospheric air introduction groove 58 and gas-liquid exchange passage 59*a* become directly connected to the negative pressure generating member 13. As a result, an ink path is formed between the ink within the ink storing portion 53 and the negative pressure generating member 13 within the negative pressure generating member holding chamber 10. In case air is present in the interface portion 14 in the state depicted in FIG. 2, (*a*), the air moves into the ink storing chamber 53 (this air is not illustrated in FIG. 3). As the ink path is formed, the ink begins to flow from the ink storing portion 53 into the negative pressure generating member 13 because of the capillary force of the negative pressure generating member 13. As this ink flow begins, the walls of the inner shell 54 begin to deform, starting from the center portion of the largest wall, in the direction to decrease the internal volume of the ink storing portion 53. Meanwhile, the wall of the outer shell 51 function to prevent the displacement of the corner portions of the inner shell 54. Therefore, the ink storing portion 53 is affected by the force generated by ink consumption in the direction to deform the ink storing portion 53, as well as the resiliency of the walls of the inner shell 54 which works in the direction to restore the initial state (FIG. 2) of the ink storing portion 53, generating negative pressure by the amount proportional to the degree of deformation, without sudden change. The spaces between the inner and outer shells 54 and 51 are connected to the outside air through the air passage 55. Therefore, the atmospheric air is introduced between the inner and outer shells 54 and 51. As for the ink introduction into the atmospheric air introduction groove 58, when the capillary force of the atmospheric air introduction groove 58 is greater than the negative pressure generated by the ink storing portion 53, as in this embodiment, the atmospheric air introduction groove 58 is filled with ink, As the ink flow begins, and the ink is filled into the negative pressure generating member 13, the ink level in the negative pressure generating member 13 reaches above the top end of the atmospheric air introduction groove 58, and eventually, the atmospheric air introduction groove 58 is cut off from the outside air. Then, the outflow of the ink from the ink reservoir 50 and the correspondent inflow of the outside air into the ink reservoir 50, that is, gas-liquid exchange, begin to occur only through the negative pressure generating member holding chamber 10. As a result, the ink flow continues until the static negative pressure in the ink reservoir 50 becomes equal to the static negative pressure in the negative pressure generating member holding chamber 10.

More specifically, in the above described state, the negative pressure on the negative pressure generating member holding chamber side is greater than that on the ink reservoir side. Therefore, ink continues to flow from the ink reservoir 50 into the negative pressure generating member holding chamber 10 until the internal negative pressures in both chambers become equal. As the ink flow continues, the amount of the ink held in the negative pressure generating member 13 in the negative pressure generating member holding chamber 10 continues to increase. As is evident from the above description, the ink flow from the ink reservoir 50 into the negative pressure generating member holding chamber 10 occurs without introduction of gas into the ink reservoir 50 through the negative pressure generating member 13. The levels of the static negative pressures for the two chambers should be set to an appropriate value ($\alpha$ in FIG. 7) according to the type of liquid jet recording means (unillustrated), such as a recording head, to be connected to the ink delivery port 12, so that ink does not leak from the liquid jet recording means after the state of equilibrium in terms of internal pressure is realized between the two chambers.

The smallest amount of ink which flows from the ink storing portion 53 into the negative pressure generating member 13 equals the amount of ink which is necessary to raise the ink level in the negative pressure generating member 13 to the top end (position of the gas-liquid interface, which will be described later) of the atmospheric air introduction groove 58, whereas the largest amount of ink which flows from the ink storing portion 53 into the negative pressure generating member 13 equals the amount of ink to exactly fill up the negative pressure generating member 13. Therefore, the amount of the ink which is possible to flow into the negative pressure generating member 13 can be determined based on the largest and smallest amounts of ink which flows into the negative pressure generating member 13, while taking into consideration the variation in the amount of the ink held in the negative pressure generating member 13 prior to the connection of the ink reservoir 50 to the negative pressure generating member holding chamber 10, and the thus determined amount of ink and the value $\alpha$ of the negative pressure when the ink container is in the state of equilibrium in terms of internal pressure can be used to choose the proper material and proper thickness for the walls of the ink storing portion 53, for the negative pressure generating member 13.

Further, since the amount of the ink held in the negative pressure generating member 13 prior to the connection of the ink reservoir 50 to the negative pressure generating member holding chamber 10 varies from one negative pressure generating member 13 to another, some regions of the negative pressure generating member 13 remain unfilled with ink even after the state of equilibrium is realized between the ink reservoir 50 and negative pressure generating member holding chamber 10. These regions can be used, along the buffer portion, as buffer regions against the changes in temperature and pressure, which will be described later.

However, when there is a possibility that the pressure at the ink delivery port becomes positive due to presence of an abnormally large amount of ink in the negative pressure generating member 13 when equilibrium in terms of internal pressure is realized, a counter measure may be taken; a performance recovery operation may be carried out by a suctioning means with which the liquid jet recording apparatus main assembly is provided, so that a small amount of ink is removed.

As for the formation of the ink path within the gas-liquid exchange passage 59*a* at the time of the connection, the ink path may be formed using the impact from the connection, or by applying pressure to the ink storing portion 53, more specifically, by applying pressure to the shell 51, at the time of the connection. Also, an arrangement may be made to keep the internal pressure of the ink storing portion 53 negative prior to the connection, so that this negative pressure can enhance the movement of the gas within the gas-liquid exchange passage 59*a* into the ink storing portion 53.

Figure 4:
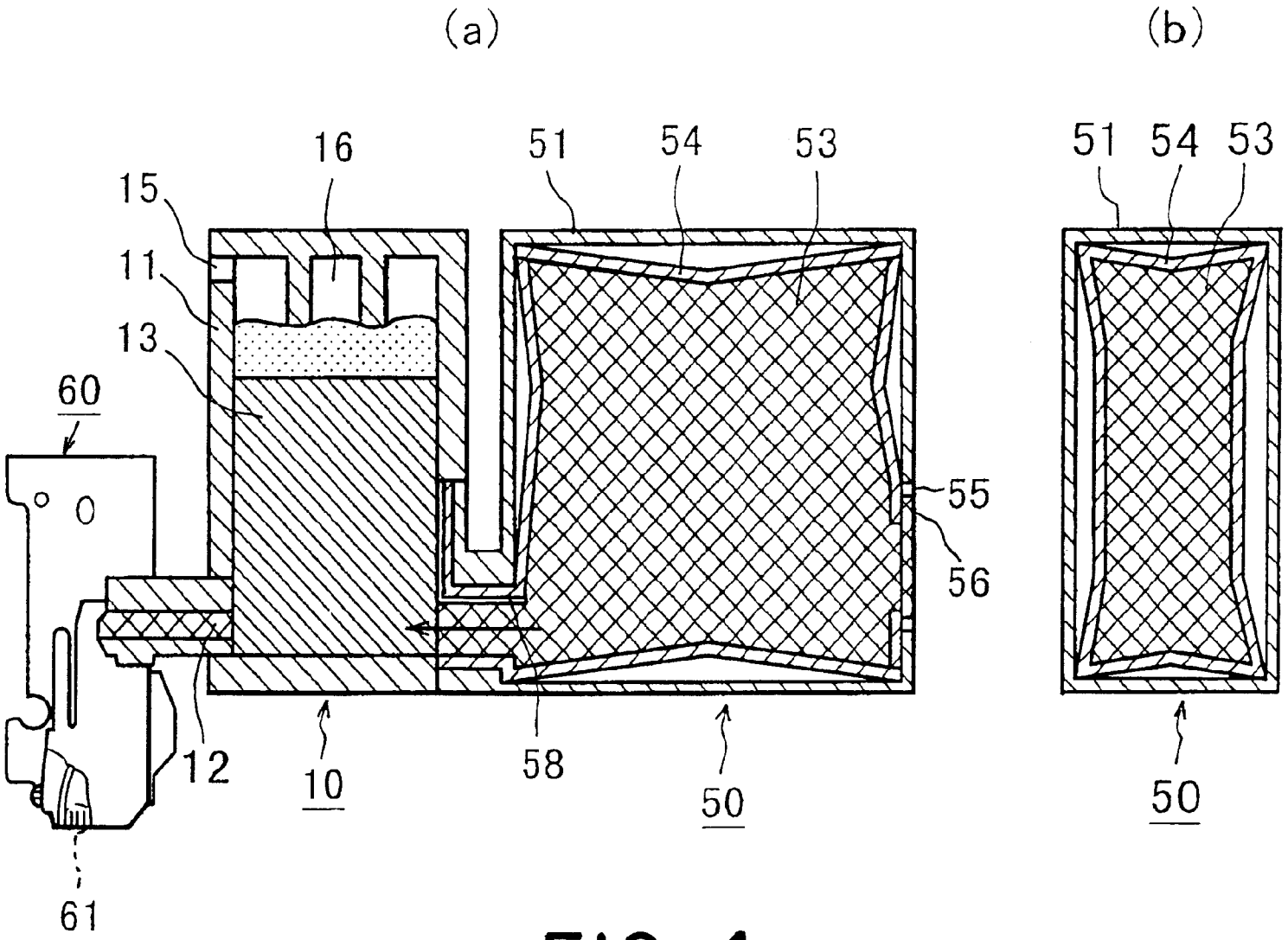
FIG. 4 is a sectional drawing for describing the ink delivery stage of the ink container illustrated in FIG. 1; (*a*) is a sectional view at the same plane as the one in the FIG. 1, (*b*), and (b) is a sectional view of the liquid reservoir at the plane A—A in FIG. 1, (*b*).

Next, the ink in the ink container begins to be consumed by the recording head 60 through the ink delivery port 12, as shown in FIG. 4. During this initial stage of ink consumption, both the ink within the ink storing portion 53 and the ink held in the negative pressure generating member 13 are consumed, with the value of the static negative pressure in the ink storing portion 53 and negative pressure generating member 13 remaining balanced while increasing (first stage of ink delivery).

In other words, as the ink is consumed through the ink delivery port 12, the ink level in the negative pressure generating member 13 in the negative pressure generating member holding chamber 10 lowers, and the ink storing portion 53 deforms further; the center portion of each wall of the ink storing portion 53 steadily displaces inward of the ink storing portion 53.

During this deformation, the pinch-off portion 56 (welding portion) functions to regulate the deformation of the walls of the inner shell 54, so that the ink storing portion walls (inner shell walls) without the pinch-off portion 56 begin to deform and separate from the correspondent walls of the outer shell 51, ahead of the ink storing portion wall with the pinch-off portion. In this embodiment, the pair of ink storing portion walls with the larger size deform at approximately the same time. Therefore, the ink storing portion 53 smoothly deforms.

While the ink container is in the state depicted in FIG. 4 the static negative pressure gradually increases in proportion to the amount of ink delivery through the ink delivery port 12 as shown by the portion of the graph in a period A in FIG. 7. Also in this first stage of ink delivery, it does not occur that air enters the ink storing portion 53 through the gas-liquid exchange passage 59*a*.

Figure 5:
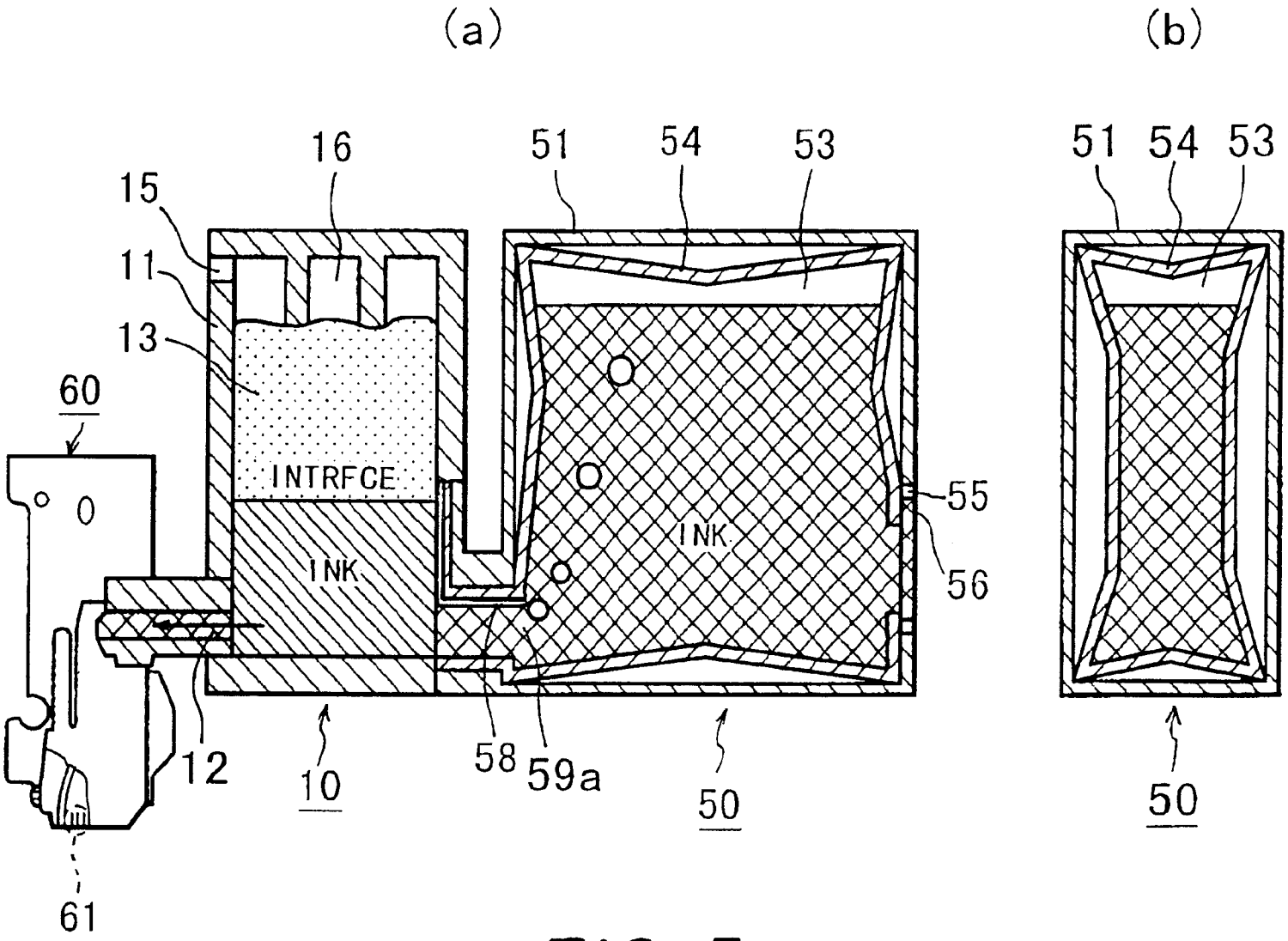
FIG. 5 is a sectional drawing for describing the gas-liquid exchange stage of the ink delivery from the ink container illustrated in FIG. 1: (a) is a sectional view at the same plane as the one in the FIG. 1, (*b*), and (b) is a sectional view of the liquid reservoir at the plane A—A in FIG. 1, (*b*).

As the ink delivery from the ink delivery port 12 continues further, air begins to be introduced into the ink storing portion 53 as shown in FIG. 5 (hereinafter, this state will be referred to as the gas-liquid exchange stage, or second stage of ink delivery).

During this second stage of ink delivery, the liquid level in the negative pressure generating member 13 remains approximately stable at the top end portion of the atmospheric air introduction groove 58 (position of the gas-liquid interface), and as the air enters the ink storing portion 53 through the air vent 15, atmospheric air introduction groove 58, and gas-liquid exchange passage 59*a*, ink flows from the ink storing portion 53 into the negative pressure generating member 13 in the negative pressure generating member holding chamber 10 through the ink delivery port 12.

Therefore, as ink is consumed by the recording head 60 as a liquid jet recording means, the absorbent member is replenished with ink in response to the consumption so that a stable amount of ink remains in the negative pressure generating member 13. Also, this introduction of air into the ink storing 53 keeps the negative pressure within the ink container virtually stable while keeping the shape of the ink storing portion virtually the same during this gas-liquid exchange stage. Therefore, the ink delivery to the liquid jet recording means remains stable. When the ink container is in the state depicted in FIG. 5, the static negative pressure in the ink container remains virtually stable in spite of the ink delivery as depicted by the portion of the graph in the period C in FIG. 7

Figure 6:
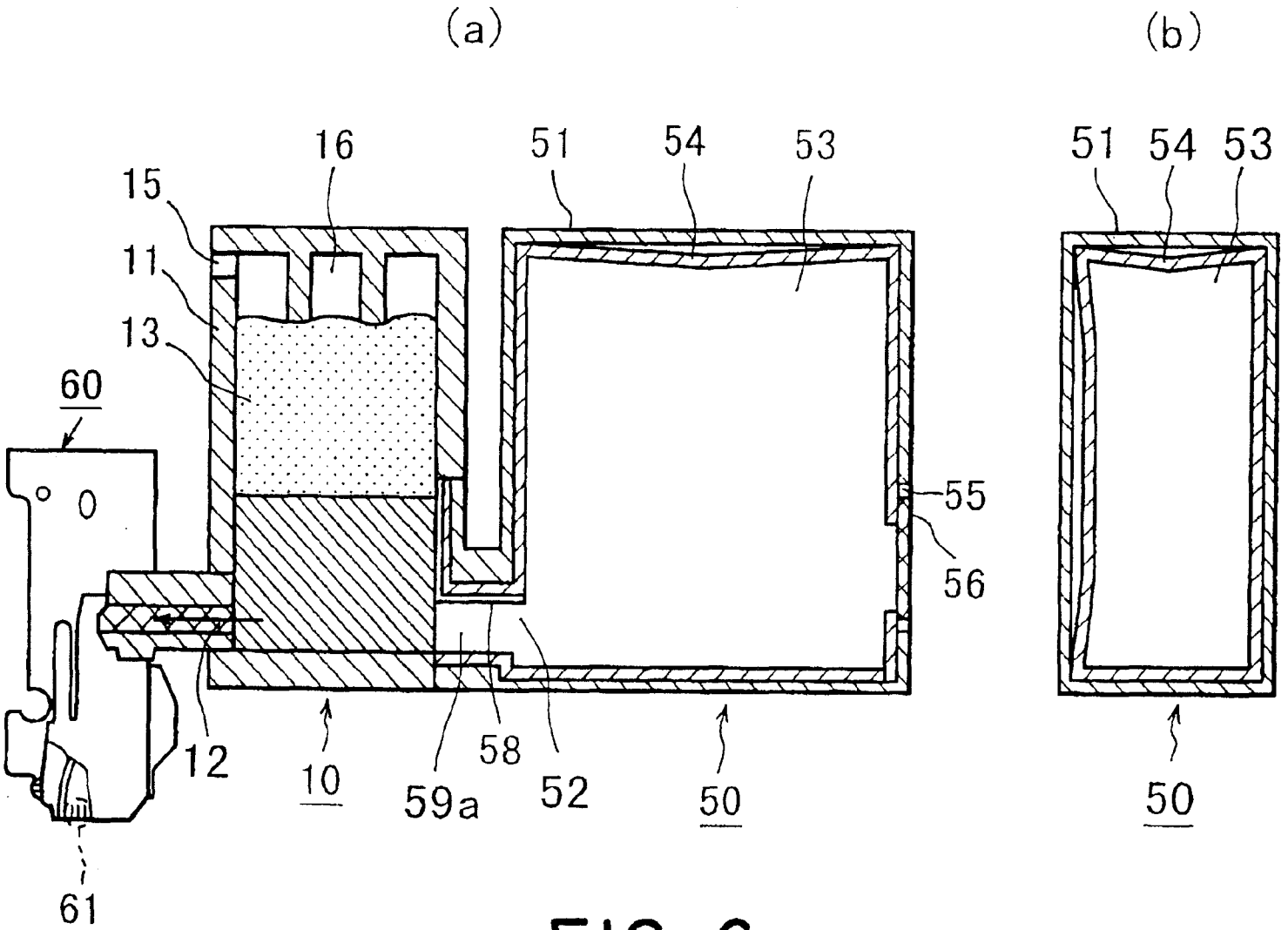
FIG. 6 is a sectional drawing for describing the state of the ink container illustrated in FIG. 1 immediately before the exchange of the ink reservoir of the ink container: (a) is a sectional view at the same plane as the one in the FIG. 1, (b), and (b) is a sectional view of the liquid reservoir at the plane A—A in FIG. 1, (*b*).
Figure 7:
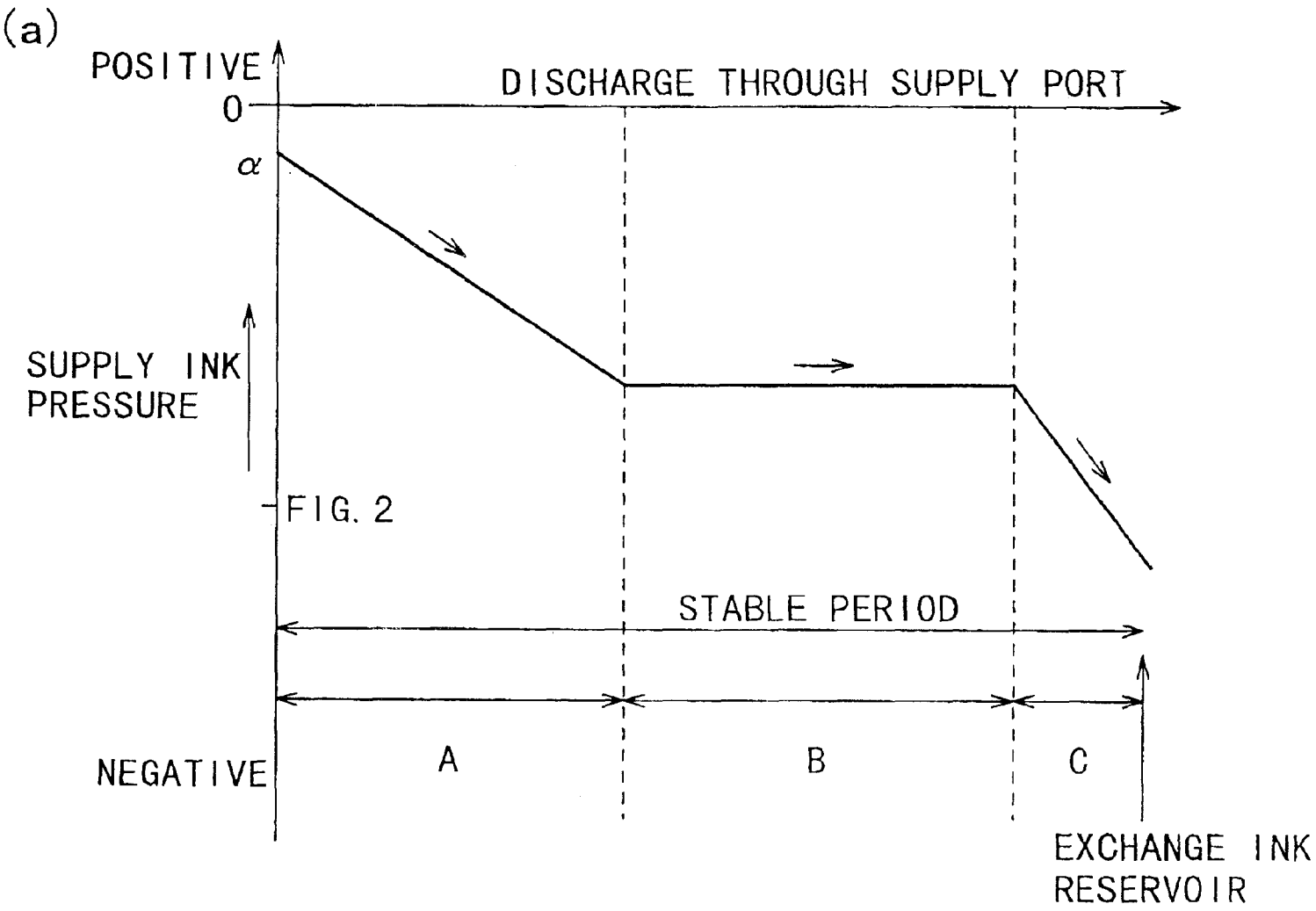
FIG. 7 is a graph which shows the relationship between the amount of the ink delivery from the ink container illustrated in FIG. 1, and the negative pressure at the ink delivery port portion.

As the ink delivery from the ink delivery port 12 continues further, the ink within the ink storing portion 53 continues to be consumed until it virtually runs out as shown in FIG. 6. Then, the ink remaining in the negative pressure generating member holding chamber 10 begins to be consumed. When the ink container is in the state depicted in FIG. 6, the negative pressure increases as shown by the portion of the graph correspondent to the period C in FIG. 7 in proportion to the amount of the ink delivery from the ink delivery port 12. After the state of the ink container reaches this stage, even if the ink reservoir 50 is separated from the negative pressure generating member holding chamber 10, there is little risk that ink will leak from the interface portion 14. Therefore, the ink reservoir 50 from which ink has been depleted may be replaced with a fresh ink reservoir such as the one depicted in FIG. 2.

The ink delivery action from the ink container illustrated in FIG. 1 is as described above. In other words, as the ink reservoir 50 is connected to the negative pressure generating member holding chamber 10, ink flows until the internal pressures in the negative pressure generating member holding chamber 10 and ink reservoir 50 become equal to each other, that is, until the ink container becomes ready for delivering ink. Thereafter, ink begins to be consumed by the liquid jet recording means. As the ink consumption begins, both the ink held in the ink storing portion 53 and the ink held in the negative pressure generating member 13 are consumed, with the values of the static negative pressure generated by the ink storing portion 53 and negative pressure generating member 13 remaining balanced while increasing, until air begins to introduced into the ink storing portion 53. Thereafter, the ink remaining in the negative pressure generating member holding chamber 10 begins to be consumed after going through the gas-liquid exchange stage in which as the atmospheric air is introduced into the ink storing portion 53, the ink is consumed while the level of the gas-liquid interface is maintained constant by the negative pressure generating member 13 so that the negative pressure is kept constant in spite of the continuous ink consumption.

As described above, the ink consumption from the ink container in accordance with the present invention goes through a stage (first stage of ink delivery) in which the ink within the ink storing portion 53 is consumed without the introduction of the outside air into the ink storing portion 53. Therefore, only the requirement regarding the internal volume of the ink reservoir 50 is to take into consideration the amount of the outside air introduced into the ink storing portion 53 at the time of the connection of the ink reservoir 50 to the negative pressure generating member holding chamber 10. In other words, the ink container in accordance with the present invention offers a benefit that it can counter the ambient changes in spite of the flexible requirement regarding the internal volume of the ink reservoir 50.

Further, the ink container in accordance with the present invention allows virtually the entire amount of ink in the ink storing portion 53 to be consumed, properly functions even if air is present in the gas-liquid exchange passage 59*a* at the time of ink reservoir exchange, and allows ink reservoir exchange regardless of the amount of ink in the negative pressure generating member 13, making it possible to provide an ink delivery system, the ink reservoir of which can be satisfactorily exchanged without the provision of an ink remainder amount detection mechanism required by the prior arts.

Further, referring to FIG. 7, in order for the negative pressure to increase in proportion to the amount of ink delivery (period A), remain steady for a period of time (period B), and then, further increase in proportion to the amount of ink delivery (period C), the atmospheric air is introduced before the opposing walls of the ink storing portion 53 come into contact with each other. In other words, it is desirable that the state of the ink container changes from the state in the period A to the state in the period B before the opposing walls of the ink storing portion 53 come into contact with each other, because, the ratio at which the negative pressure changes in response to the amount of the ink delivery from the ink storing portion is different between the period before and the period after the opposing walls with the larger size come into contact with each other.

Also according to the present invention, the ink container is structured so that even when air is contained in the ink storing portion, for example, when the ink container is in the second stage of ink delivery, the ambient changes are dealt with by a solution different from the one based on the prior arts.

Figure 8:
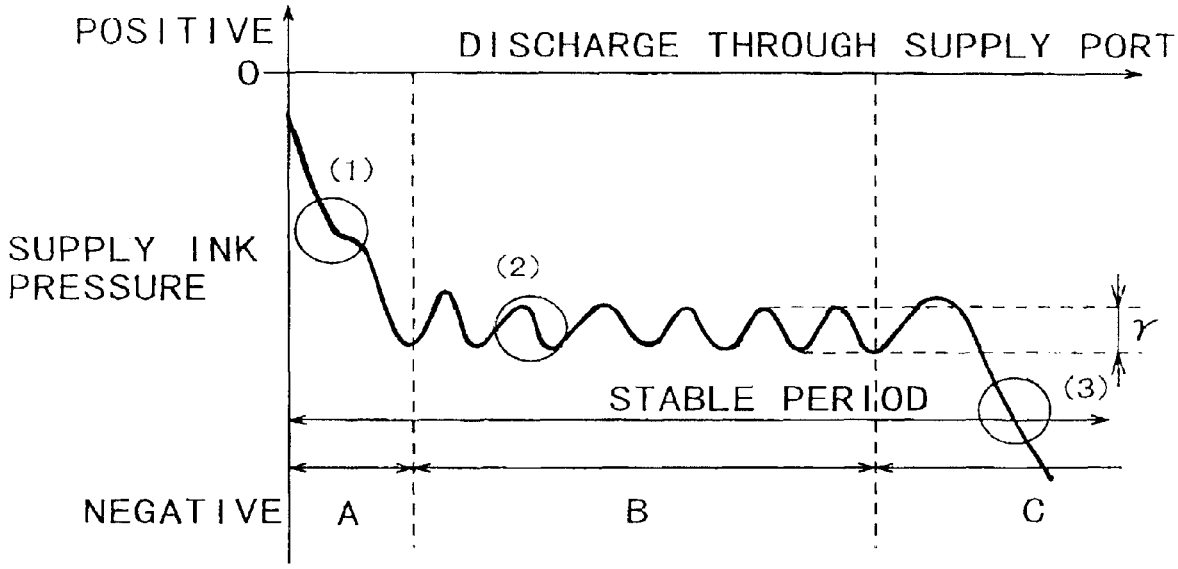
FIG. 8, (*a*) is a graph which shows the details of the negative pressure curve given in FIG. 7, and FIG. 8, (*b*) is a graph which describes the changes occurring, with the elapse of time, to the amount of the ink delivered from the ink storing portion, and the amount of the air introduced into the ink storing portion, as the ink is continuously delivered.
Figure 8:
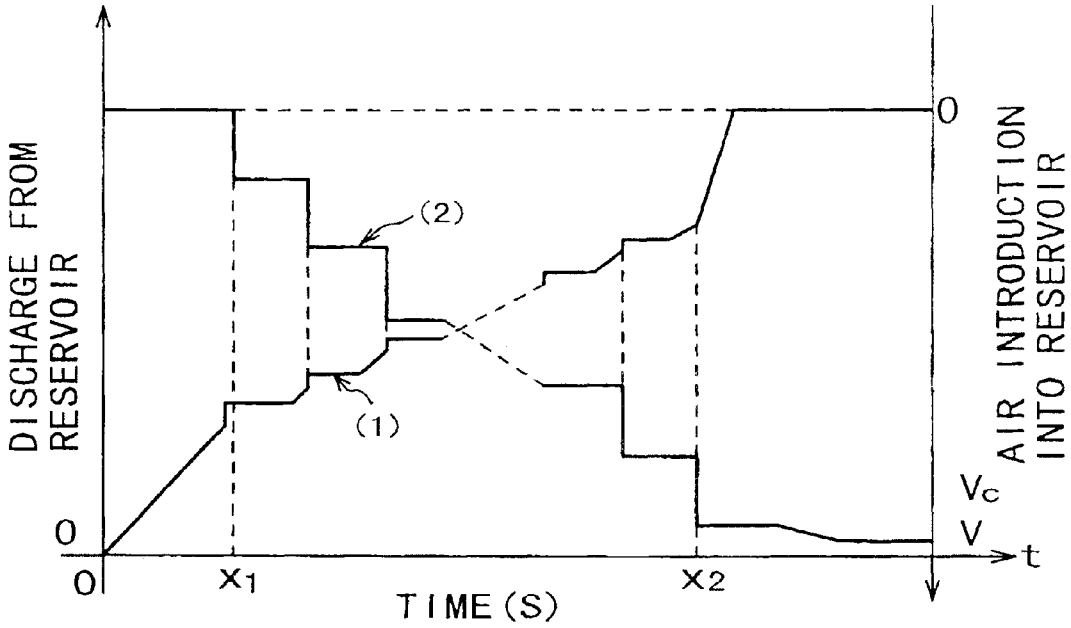
Figure 9:
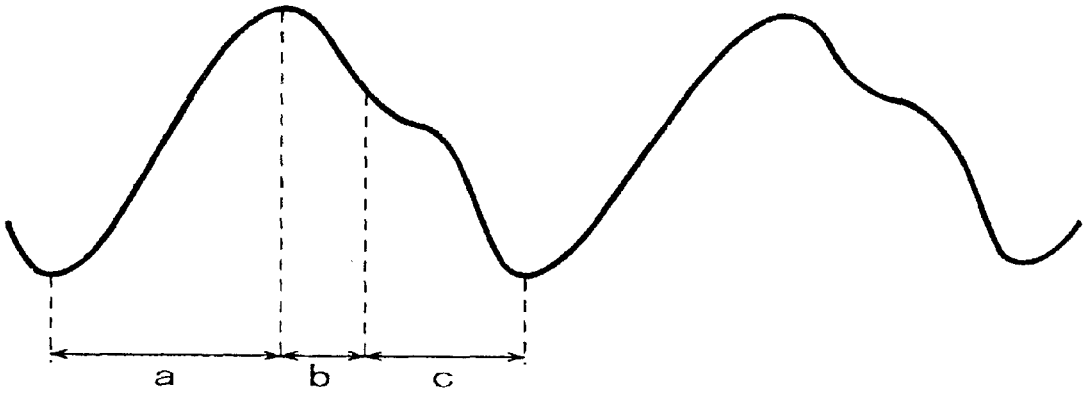
FIG. 9 is a detailed drawing of a portion of the negative pressure curve correspondent to the ink delivery period B in FIG. 8.
Figure 10:
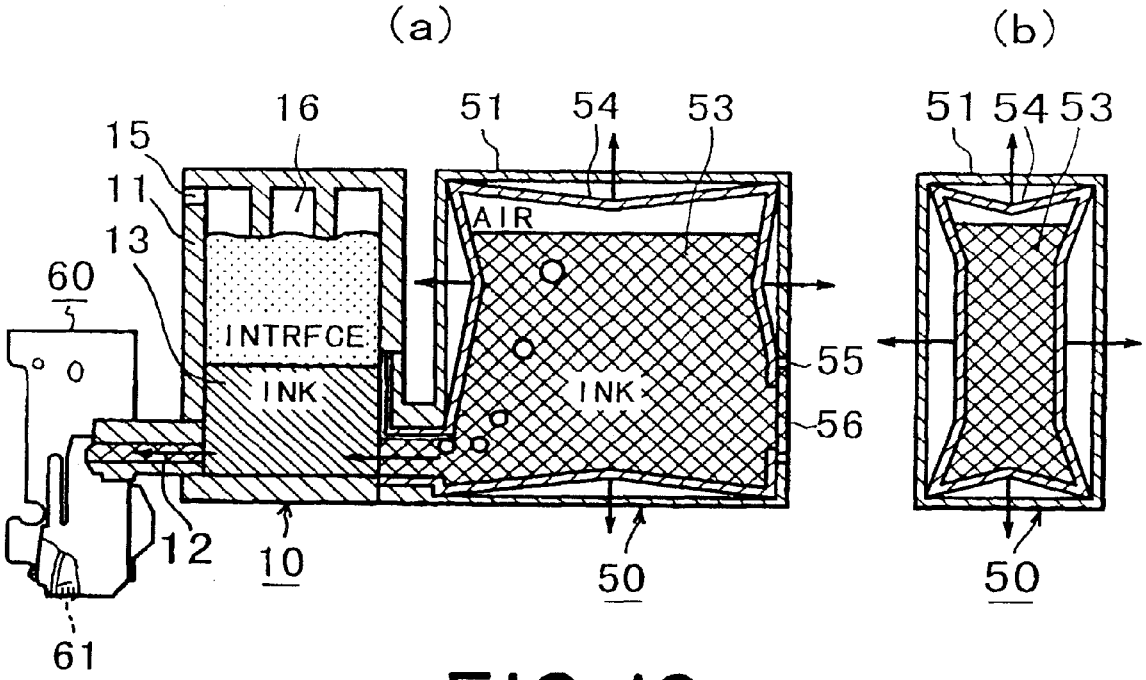
FIG. 10 is a sectional view of the ink container, which describes the ink container action correspondent to the period a in FIG. 9.
Figure 11:
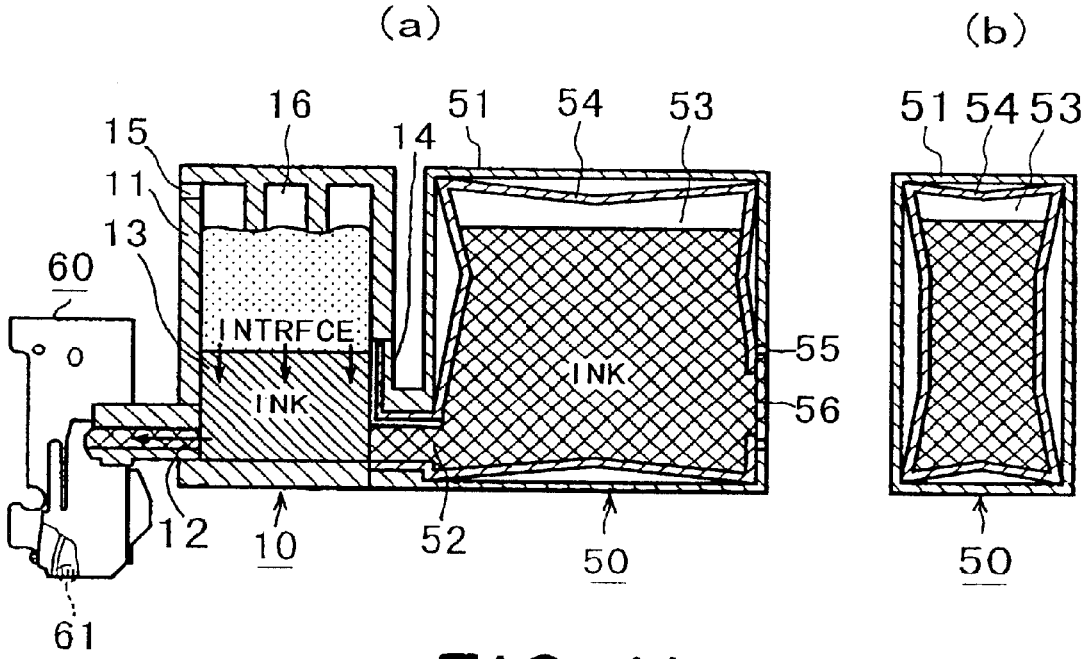
FIG. 11 is a sectional view of the ink container, which describes the ink container action correspondent to the period b in FIG. 9.
Figure 12:
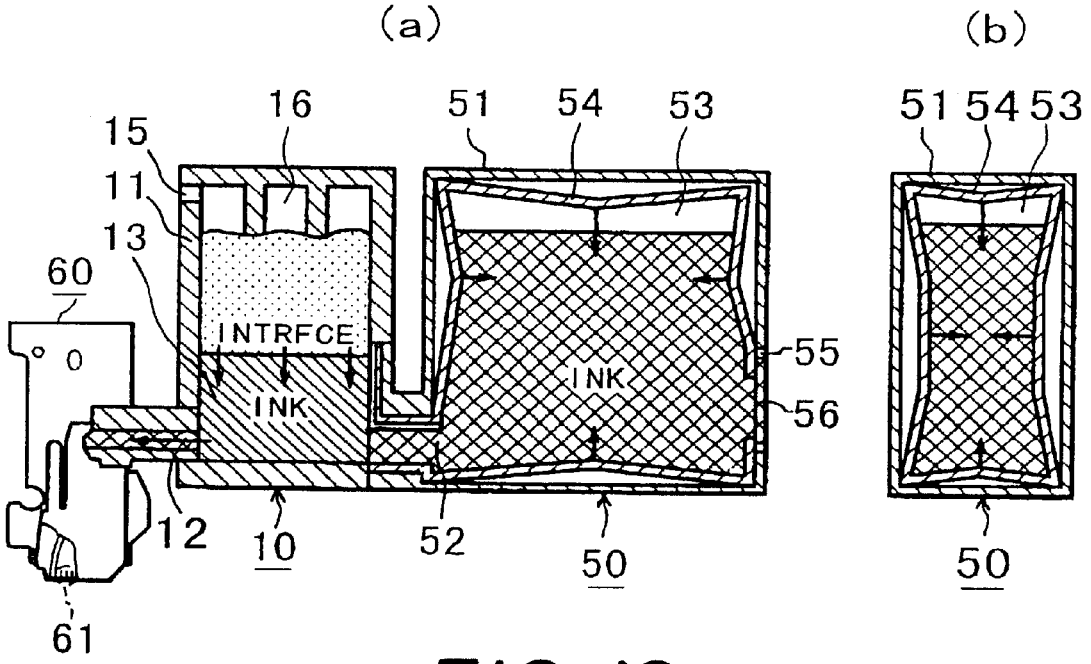
FIG. 12 is a sectional view of the ink container, which describes the ink container action correspondent to the period c in FIG. 9.
Figure 13:
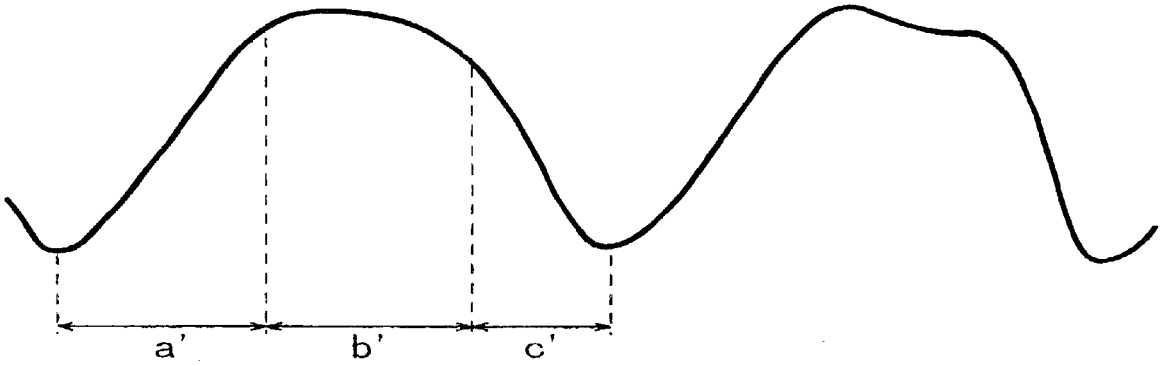
FIG. 13 is a detailed drawing of a portion of the negative pressure curve in an ink delivery period of another ink container, correspondent to the ink delivery period B in FIG. 8.
Figure 14:
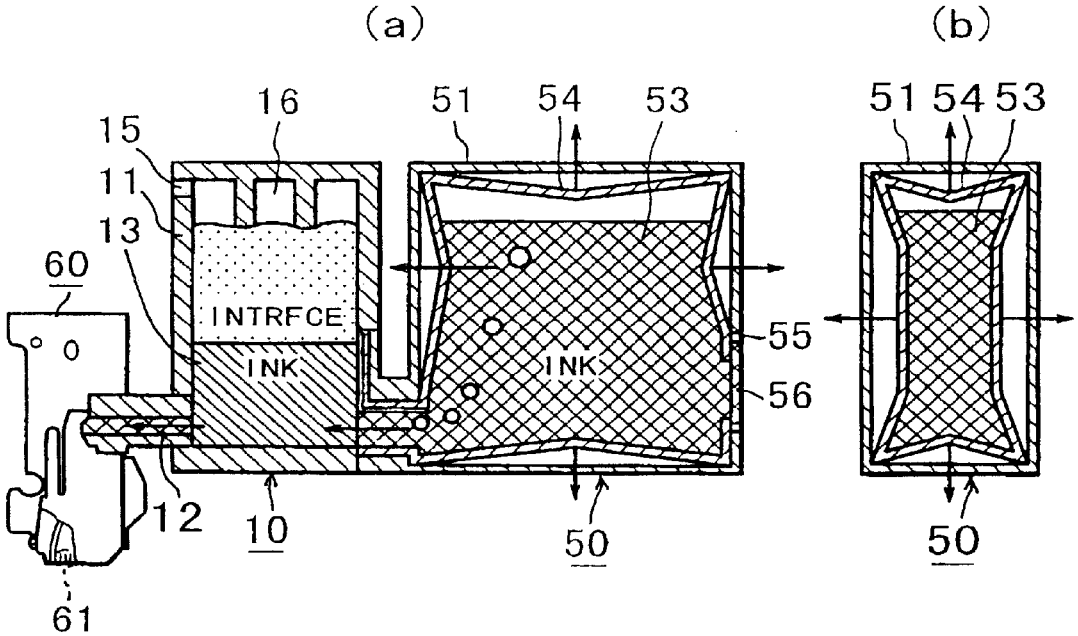
FIG. 14 is a sectional view of the ink container, which describes the ink container action correspondent to the period a in FIG. 13.
Figure 15:
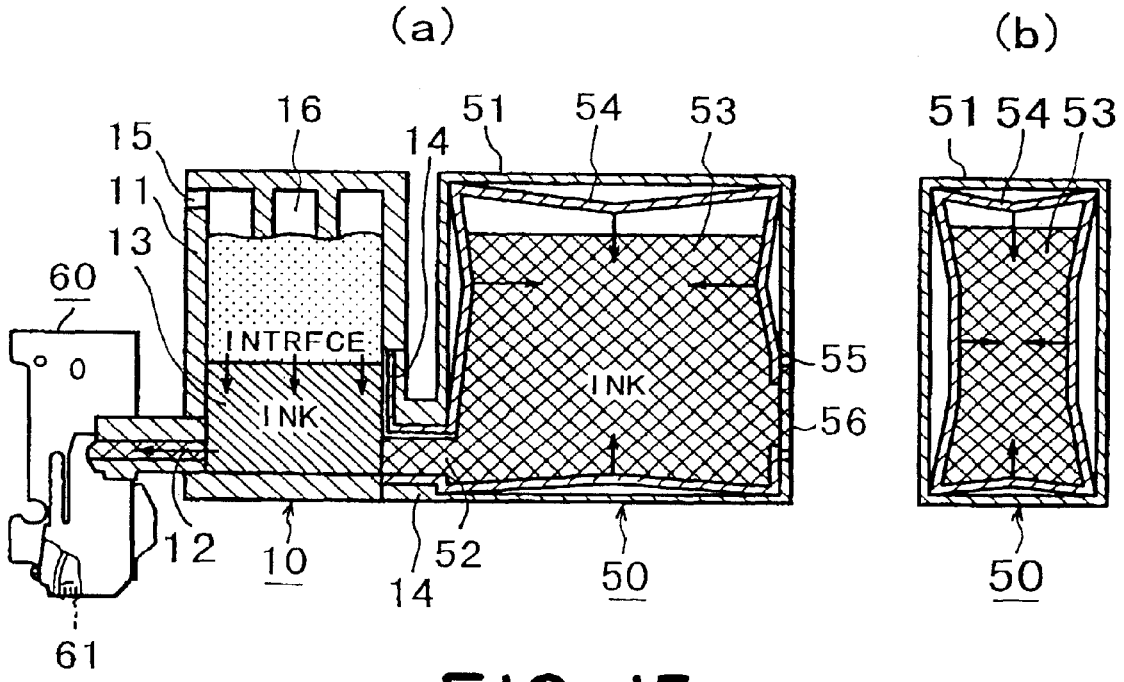
FIG. 15 is a sectional view of the ink container, which describes the ink container action correspondent to the period b in FIG. 13.
Figure 16:
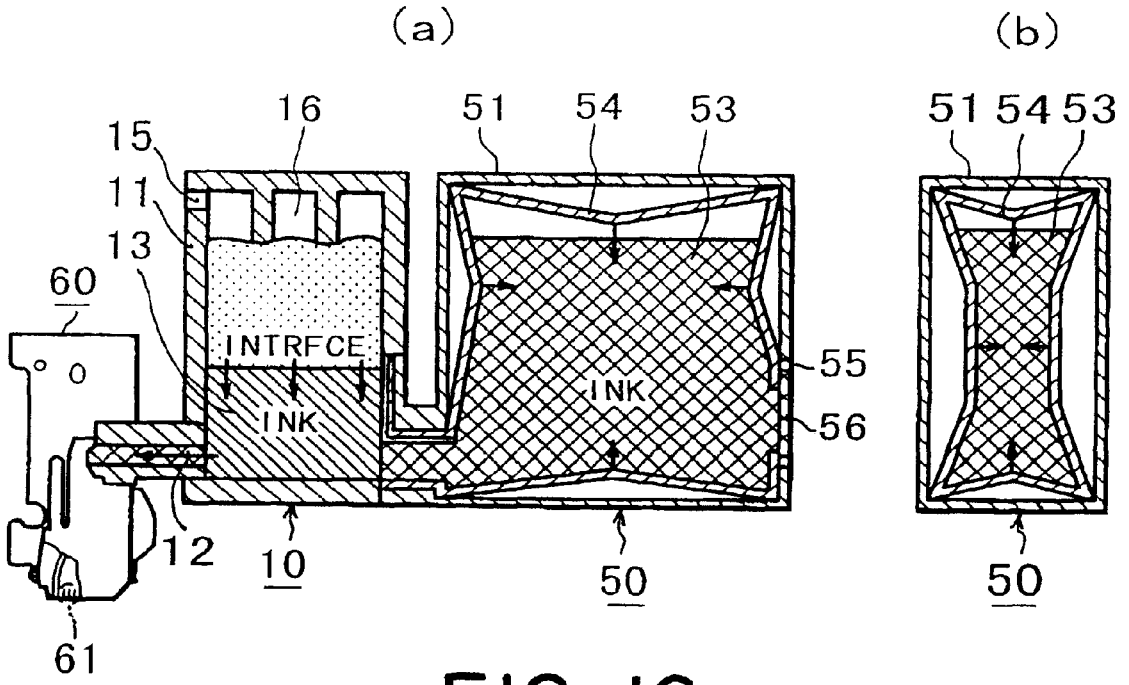
FIG. 16 is a sectional view of the ink container, which describes the ink container action correspondent to the period c in FIG. 13.

FIG. 8 is a graph in which the curved line represents one example of the actual change in the negative pressure correspondent to the theoretical change in the negative pressure shown by in FIG. 7. In FIG. 8, the portions of the curved line designated by (1), (2), and (3) correspond to the ink delivery stages prior to the beginning of air-liquid exchange, during the air-liquid exchange, and after the air-liquid exchange. FIG. 9 is a graph which shows the details of the change in the negative pressure represented by the curved line in the period B in FIG. 8. FIGS. 10–12 are sectional views of the ink container in this embodiment, which correspond to periods a, b, and c of the graph, and describe the actions occurring in the ink container. FIG. 13 is a drawing which shows the detail of the negative pressure curve in another embodiment, correspondent to the curved line in the period B in FIG. 8. FIGS. 14–16 are sectional views of the ink container in this embodiment, and describe the actions in the ink container correspondent to the periods a', b' and c' of FIG. 13. In FIGS. 10–12, and FIGS. 14–16, a drawing (a) is a sectional view of the ink container at the same plane as the one for FIG. 1, (*b*), and a drawing (b) is a sectional view of the ink reservoir at the same plane as the sectional plane A—A for FIG. 1, (*b*). In these drawings, which will be used for the following description of the present invention, the deformations and the like of the ink reservoir are slightly exaggerated to make the description easier to understand.

(1) Description of Ink Delivery Actions Correspondent to Period (1) in FIG. 8

The ink delivery action (ink delivery action prior to the beginning of the air-liquid exchange) shows three patterns, each of which will be separately described. Each pattern is included in this application of the present invention. The pattern of the ink delivery action changes in response to various factors, for example, magnitude of the capillary force of the negative pressure generating member, thickness of the walls of the ink reservoir, type of the material for the ink reservoir, and also the interactions among them.

<First Pattern Correspondent to Period (1) in FIG. 8>

This pattern occurs when the ink storing portion 53 is dominant over the negative pressure generating member 13 in regulating the negative pressure. Specifically, this pattern occurs with higher frequency when the walls of the inner shell 54 of the ink reservoir 50 are relatively thick, and also, relatively high in rigidity.

In the initial stage of ink delivery, the ink in the negative pressure generating member 13 is delivered, because the resistance to the delivery of the ink in the negative pressure generating member 13 is smaller than the resistance to the delivery of the ink in the ink reservoir 50. After the initial delivery of the ink in the negative pressure generating member 13 as described above, ink is delivered from both the ink storing portion 53 and negative pressure generating member 13, with balance being maintained between the negative pressures in the negative pressure generating member 13 and ink reservoir 50. As the ink is delivered from the ink reservoir 50, the walls of the inner shell deform inward of the ink reservoir 50.

<Second Pattern Correspondent to Period (1) in FIG. 8>

This pattern occurs when the negative pressure generating member 13 is dominant over the ink storing portion 53 in regulating the negative pressure, which is contrary to the first pattern. Specifically, this pattern occurs with higher frequency when the walls of the inner shell 54 of the ink reservoir 50 are relatively thin, and also, relatively low in rigidity.

In the initial stage of ink delivery, ink is delivered from the ink reservoir 50, because the resistance to the ink delivery from the ink reservoir 50 is smaller than the resistance to the ink delivery from the negative pressure generating member 13. After the initial ink delivery from the ink reservoir 50, ink is delivered from both the ink storing portion 53 and negative pressure generating member 13, with balance being maintained between the negative pressures in the negative pressure generating member 13 and ink reservoir 50 as described above.

<Third Pattern Correspondent to Period (3) in FIG. 8>

This pattern tends to occur when the negative pressure is equally regulated by the negative pressure generating member 13 and ink storing portion 53.

In this pattern, in the initial stage of ink delivery, ink is delivered from both the negative pressure generating member 13 and ink storing portion 53, with balance being maintained between the negative pressures in the negative pressure generating member 13 and ink reservoir 50. This balance is maintained as the state of the ink container changes from the initial stage of ink delivery to the air-liquid exchange stage, which will be described later.

(2) Description of Ink Delivery Action Correspondent to Period (2) of FIG. 8

Next, the ink delivery in the air-liquid exchange stage will be described. The ink delivery action shows two patterns. These pattern will be described in further detail, with reference to an enlarged drawing of the portion of the curved line correspondent to the period (2) in FIG. 8.

<First Pattern Correspondent to Period (2) in FIG. 8>

This pattern occurs when the ink storing portion 53 is dominant over the negative pressure generating member 13 in regulating the negative pressure. More specifically, this pattern occurs with higher frequency when the walls of the inner shell 54 of the ink reservoir 50 are relatively thick, and also, relatively high in rigidity.

In the gas-liquid exchange stage, the atmospheric air is introduced into the ink reservoir 50 from the negative pressure generating member holding chamber 10 (period a in FIG. 9). This air introduction is for easing the negative pressure imbalance between the negative pressure generating member holding chamber 10 and ink reservoir 50. As the result of air introduction into the ink reservoir 50, the walls of the inner shell 54 of the ink reservoir 50 slightly deform outward as shown in FIG. 10. Ink is supplied from the ink reservoir 50 to the negative pressure generating member holding chamber 10 as the air is introduced into the ink reservoir 50, and as a result, the liquid level in the negative pressure generating member holding chamber 10 rises slightly (FIG. 10→FIG. 11).

In this embodiment, as more air is introduced into the ink reservoir 50, first, ink is delivered from the negative pressure generating member 13, and as a result, the liquid level in the negative pressure generating member holding chamber 10 moves downward (curved line in period b in FIG. 9) (FIG. 11).

After the above stage, ink is delivered from both the negative pressure generating member 13 and ink storing portion 53, with balance being maintained between the negative pressures in the two chambers. As a result, the liquid level in the negative pressure generating member 13 falls further, and the walls of the inner shell 54 of the ink reservoir 50 deforms inward of the ink reservoir 50 (curved line in period c in FIG. 9) (FIG. 12).

After the continuance of the above state for a certain length of time, the atmospheric air begins to be introduced into the ink storing portion 53 through the atmospheric air introduction groove 58. As a result, the internal pressure increases as the curved line in period a in FIG. 9 indicates.

<Second Pattern Correspondent to Period (2) in FIG. 8>

This pattern occurs when the negative pressure generating member 13 is dominant over the ink storing portion 53 in regulating the negative pressure, which is contrary to the first pattern. More specifically, this pattern tends to occur when the walls of the inner shell 54 of the ink reservoir 50 are relatively thin, and also, relatively low in rigidity.

As described above, in the gas-liquid exchange stage, air is introduced from the negative pressure generating member holding chamber 10 into the ink reservoir 50 (period a' in FIG. 13). As the result of this air introduction into the ink reservoir 50, the walls of the inner shell 54 of the ink reservoir 50 slightly deform outward as shown in FIG. 14. Ink is supplied from the ink reservoir 50 into negative pressure generating member holding chamber 10 in response to the air introduction. As a result, the liquid level in the negative pressure generating member holding chamber 10 rises slightly (FIG. 14→FIG. 15).

In this pattern, as more air is introduced into the ink reservoir 50, ink is delivered dominantly from the ink reservoir 50. In this stage, the negative pressure does not change much; it gently increases, because of the characteristics of the ink reservoir 50 in thickness and rigidity of wall. As the result of this ink delivery, the walls of the inner shell 54 of the ink reservoir 50 gradually deform inward in response to the ink delivery (period b' in FIG. 13).

During this period, almost no ink is delivered from the negative pressure generating member 13. Therefore, the liquid level in the negative pressure generating member 13 hardly changes.

Also during this period b' in FIG. 13, ink is delivered from both the negative pressure generating member 13 and ink storing portion 53, with balance being maintained between the negative pressures in the former and the latter, until the period c' in FIG. 13 begins. In this period c' in FIG. 13, the liquid level in negative pressure generating member 13 falls as described above, and the walls of the inner shell 54 of the ink reservoir 50 deform inward (period c' in FIG. 13)(FIG. 16).

After the period c' in FIG. 13, atmospheric air is introduced into the ink storing portion 53 through the atmospheric air introduction groove 58. Then, the beginning of the next ink delivery sub-cycle, correspondent to the period a' in FIG. 13, begins.

(3) Description of Ink Delivery in a period (3) in FIG. 8

Lastly, the ink delivery in the period (3) in FIG. 8, that is, the ink delivery after the gas-liquid exchange period, will be described.

In this period, that is, the period after the gas-liquid exchange period ends as the result of the delivery of more ink, the ink within the ink reservoir 50 is virtually depleted, and therefore, ink is delivered mainly from the negative pressure generating member 13. The ink delivery in this period occurs in two patterns, which will be described below.

<First Pattern Correspondent to Period (3) in FIG. 8>

Here, a case in which the internal pressure of the ink storing portion becomes virtually the same as the atmospheric pressure after the gas-liquid exchange period will be described.

At the end of the gas-liquid exchange period, the ink within the ink reservoir 50 has been virtually entirely consumed. Therefore, generally speaking, meniscuses have been formed in the atmospheric air introduction groove 58, the passage between the negative pressure generating member holding chamber 10 and ink reservoir 50, and/or the negative pressure generating member 13. However, as the liquid level in the negative pressure generating member 13 drops below the top end of the atmospheric air introduction groove 58, these meniscuses break due to the carriage vibration or the like. As a result, a clear air passage is established between the outside of the ink container and the ink storing portion 53 through the atmospheric air introduction groove 58, virtually equalizing the internal pressure of the ink storing portion 53 to the atmospheric pressure. As a result, the walls of the inner shell 54 of the ink reservoir 50, which have deformed inward, deform outward because of their resiliency. However, they generally fail to return to their original positions. This is because, as described above, the walls deform inward in response to the ink delivery from the ink reservoir 50, and if the deformation of the walls exceeds a certain point, they tend to buckle, and once they buckle, they tend to fail to return to their original states. Thus, even after the internal pressure of the ink storing portion 53 becomes the same as the atmospheric pressure, the walls tend to fail to return to their original positions.

After the internal pressure of the ink storing portion 53 becomes the same as the atmospheric pressure, and the walls of the inner shell 54 return to virtually the original positions, ink is delivered from the negative pressure generating member 13. As a result, the liquid level in the negative pressure generating member 13 falls, causing the negative pressure to increase in inverse proportion to the ink delivery.

<Second Pattern Correspondent to Period (3) in FIG. 8>

Here, a case in which even after the liquid level of the negative pressure generating member 13 falls below the top end portion of the atmospheric air introduction groove 58, the internal pressure of the ink reservoir remains negative, will he described.

As described above, the internal space of the ink storing portion 53 is cut off from the outside air by the meniscuses within the atmospheric air introduction groove 58, passage between the negative pressure generating member holding chamber 10 and ink reservoir 50, and/or negative pressure generating member 13. Sometimes, ink continues to be consumed under this condition, causing the liquid level in the negative pressure generating member 13 to continue to fall. If this happens, the ink in the negative pressure generating member 13 is consumed while the walls of the inner shell 54 of the ink reservoir 50 remain deformed inward.

Also in the above described situation, however, the aforementioned meniscuses break due to causes such as the carriage vibration, ambient change, and/or the like, during the consumption of the ink, allowing the internal pressure of the ink storing portion 53 to become virtually equal to the atmospheric pressure. Also in this case, the walls of the inner shell 54 of the ink reservoir 50 return to virtually their original states.

As described above, the ink container system structured in accordance with the present invention is characterized in that its pressure fluctuation (amplitude $\gamma$) during the gas-liquid exchange period is relatively large compared to the pressure fluctuation of an ink container system based on the prior arts.

This is because, in the case of the ink container system structure in accordance with the present invention, before the gas-liquid exchange begins, the walls of the inner shell 54 are caused to deform inward by the ink delivery from the ink reservoir 50, as described with reference to Period (1) in FIG. 8. Therefore, the walls of the inner shell 54 always remain under the force generated by their own resiliency in the direction to deform them outward. Thus, the amount of the atmospheric air which enters the ink storing portion 53 during the gas-liquid exchange period, to ease the pressure difference between the negative pressure generating member 13 and ink storing portion 53, sometimes exceeds a predetermined amount, which tends to cause an increase in the amount of the ink delivered from the ink reservoir 50 into the negative pressure generating member holding chamber 10. In comparison, in the case of a conventional system, in which the ink reservoir does not deform, ink is delivered into the negative pressure generating member holding chamber 10 as soon as a predetermined amount of air enters.

For example, when in the solid printing mode, a large amount of ink is ejected all at once, causing ink to be rapidly delivered from the ink container. However, in the case of an ink container in accordance with the present invention, the amount of ink delivered through the gas-liquid exchange is relatively large compared to an ink container based on the prior arts, eliminating the possibility of temporary failure in ink delivery, and therefore, adding to reliability.

Also in the case of the structure in accordance with the present invention, ink is delivered while the walls of the inner shell 54 of the ink reservoir 50 remain inwardly deformed. Therefore, it is superior in buffering the effects of the external disturbances such as the carriage vibration, ambient changes, and the like.

At this time, the operation of the ink container during the above described ink consumption sequence, will be described from a different point of view with reference to FIG. 8, (*b*).

In FIG. 8, (*b*), the axis of abscissas stands for elapsed time, and the axis of ordinates stands for the amount of ink delivery from the ink storing portion, as well as the amount of air introduction into the ink storing portion. It is assumed that the amount of ink ejected from the ink jet head per unit period remains constant during this ink delivery period.

With the above provision, the amount of ink delivered from the ink storing portion is represented by a solid line (1), and the amount of air introduced into the ink storing portion is represented by a solid line (2).

A period from $t_0$ to $t_1$ corresponds to the period A in FIG. 8, (*a*), that is, the period prior to the gas-liquid exchange period. In this period, ink is ejected from the head, with balance being maintained between the negative pressures in the negative pressure generating member 13 and ink storing portion 53, as described above. The ink delivery patterns in this example are the same as those described above.

Next, a period from $t_1$ to $t_2$ corresponds to the gas-liquid exchange period (period B) in FIG. 8, (*a*). During this period, the gas-liquid exchange continues based on negative pressure balance such as the one described above. Ink is delivered from the ink storing portion 53 as air is introduced into ink storing portion 53, as depicted by the solid line (1) in FIG. 8, (*b*). It is not true that during this ink delivery process, ink is delivered from the ink storing portion 53 by the amount equal to the amount of the introduced air, immediately after the introduction of the air. As a matter of fact, ink is delivered by the amount equal to the total amount of the introduced air, a certain length of time after the air introduction. In other words, as is evident from this drawing, there is a difference in the timing with which the ink is delivered from the ink storing portion 53, between the ink container in accordance with the present invention and the ink container based on the prior arts. The above described ink delivery sub-cycle is repeated during this gas-liquid exchange period, and eventually, the amounts of the air and ink within the ink storing portion 53 reverse at a certain point in time.

After the point $t_2$, the period correspondent to the period C in FIG. 8, (*a*), that is, the post-gas-liquid exchange period, begins. During this period, the internal pressure of the ink storing portion 53 becomes virtually equal to the atmospheric pressure as described above. Then, the ink container is restored to the initial state of ink delivery by the resiliency of the walls of the inner shell 54 of the ink reservoir 50. However, because of the aforementioned buckling of the walls, it does not occur that the ink container is completely restored to the initial state of ink delivery. Thus, the actual total amount Vc of the air introduced into the ink storing portion 53 is smaller than the theoretical capacity V of the ink storing portion 53 (V>Vc). Also in this period, the ink in the ink storing portion 53 is completely consumed.

Next, the sequence which occurs when the ink reservoir 50 is exchanged during various stages of ink delivery will be described with reference to FIG. 17.

Figure 17:
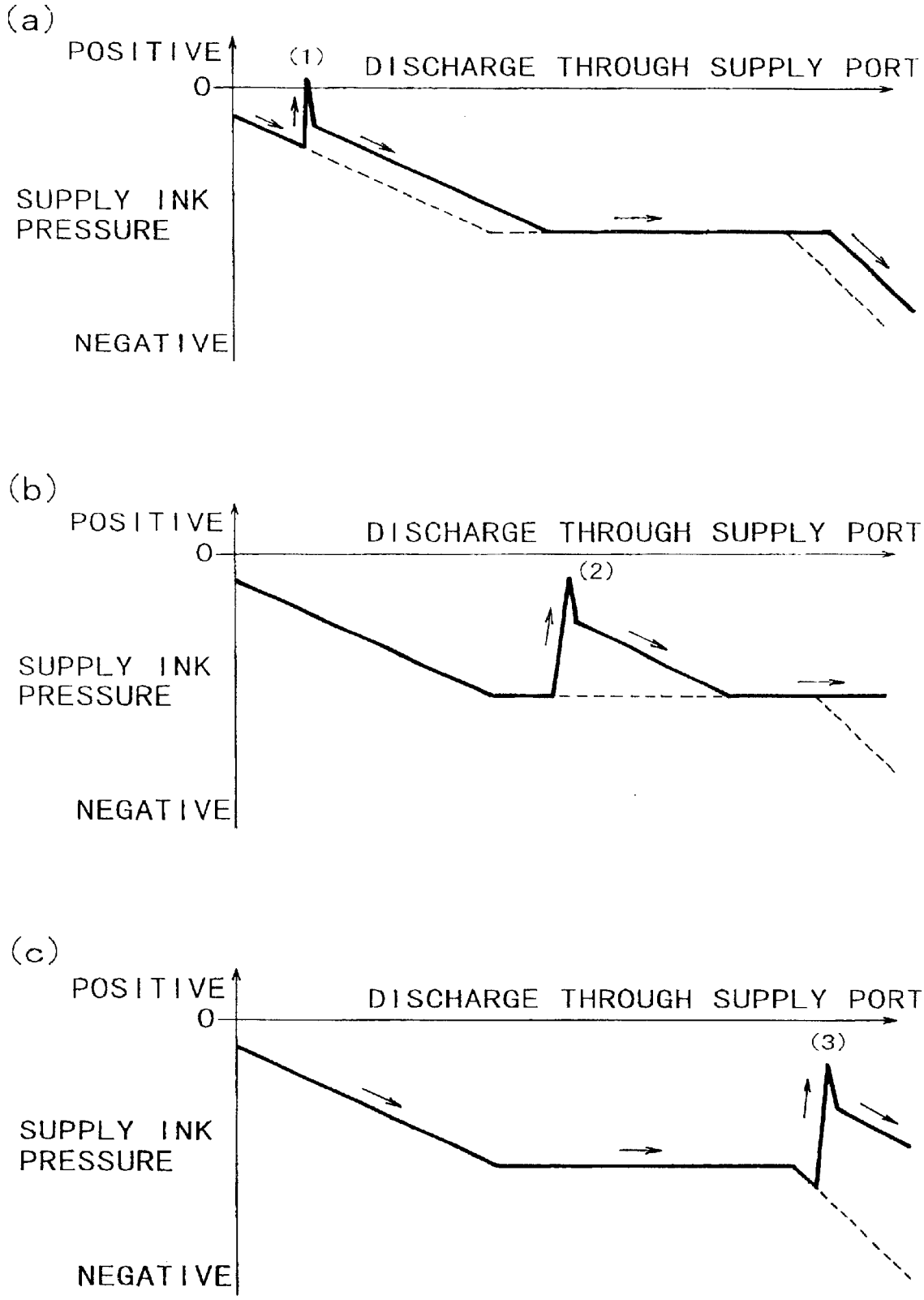
FIG. 17 is a graph which describes the actions in the ink container at the time of the ink reservoir exchange.

(a) When the Ink Reservoir is Exchanged Prior to the Gas-Liquid Exchange Stage (FIG. 17, (*a*))

As described above, prior to the gas-liquid exchange stage, ink is consumed from both the negative pressure generating member 13 and ink reservoir 50, with balance being maintained between the negative pressures in the former and latter. In this state, the negative pressure continues to increase in reverse proportion to the ink consumption, and the ink level in the negative pressure generating member 13 remains above the top end of the atmospheric air introduction groove.

If the ink reservoir 50 is exchanged during this stage, the ink in the ink reservoir 50 is supplied to the negative pressure generating member 13 as a fresh ink reservoir is connected, because, the internal pressure of the ink reservoir 50 is generally only slightly negative, although it is occasionally positive. As a result, the liquid level in the negative pressure generating member holding chamber 10 rises, and stabilizes as the negative pressures in the former and latter become balanced. Since there is the aforementioned buffer zone above the negative pressure generating member 13, ink does not leak through the air vent 15 even if the liquid level rises.

As the ink reservoir 50 is connected, the negative pressure generally decreases, although the internal pressure occasionally turns positive. If it turns positive, it can be quickly changed to negative by carrying out a performance recovery operation or the like immediately after the connection, so that a proper amount of negative pressure is provided. After the connection, ink is consumed following the aforementioned consumption pattern.

In the case of a liquid delivery system in accordance with the present invention, even when the negative pressure generating member 13 in the negative pressure generating member holding chamber 10 is not filled with ink, adjacent to the gas-liquid exchange passage, the ink in the ink storing portion 53 can be moved into the negative pressure generating member 13 by using the capillary force in the negative pressure generating member holding chamber 10, as long as an ink path is formed between the ink reservoir 50 and negative pressure generating member holding chamber 10. Therefore, it is assured that, as long as the ink reservoir 50 is properly connected, the ink in the ink reservoir 50 can be used regardless of the state of ink retention in the negative pressure generating member 13, adjacent to the interface portion 14.

(b) When the Ink Reservoir is Exchanged During the Gas-Liquid Exchange Period (FIG. 17, (*b*))

During the gas-liquid exchange period, the liquid level in the negative pressure generating member 13 generally remains stable at the top end portion of the atmospheric air introduction groove 58, and the walls of the inner shell 54 of the ink reservoir 50 remain inwardly deformed, as described above.

In this state, if the ink reservoir 50 is removed and an ink reservoir 50 in the initial state of ink delivery is connected, the ink in the ink reservoir 50 is supplied to the negative pressure generating member 13, and the liquid level in the negative pressure generating member 13 rises; in other words, the liquid level rises above the atmospheric air introduction groove 58. As a result, the walls of the inner shell 54 of the ink reservoir 50 deform inward, and yet, the internal pressure of the ink reservoir 50 remains slightly negative.

After the stabilization of the ink level, ink is consumed following the aforementioned consumption patterns ((1)-1-(1)-3). Then, as the internal pressure reaches a predetermined negative level, the gas-liquid exchange begins.

(c) When the Ink Container is Exchanged After the Gas-Liquid Exchange Period (FIG. 12, (*c*))

After the gas-liquid exchange period, the liquid level in the negative pressure generating member 13 is below the top end portion of the atmospheric air introduction groove 58, and the internal pressure of the ink reservoir 50 is approximately the same as the atmospheric pressure, as described above. The walls of the inner shell 54 have returned to their original states, or remain inwardly deformed, although the internal pressure of the ink reservoir 50 remains negative.

Also in this state, if the ink reservoir 50 is exchanged, the ink in the ink reservoir 50 is supplied to the negative pressure generating member side, causing the liquid level in the negative pressure generating member 13 to rise. In this case, the liquid level generally rises above the top end of the atmospheric air introduction groove 58, although there is chance that the liquid level will settle below the atmospheric air introduction groove 58. As the result of this ink delivery, the walls of the inner shell 54 of the ink reservoir 50 deform inward, and yet, the internal pressure of the ink reservoir 50 remains on the slightly negative side.

If the liquid level rises above the atmospheric air introduction groove 58, the gas-liquid exchange begins after the aforementioned ink consumption process, whereas if the liquid level settles below the atmospheric air introduction groove 58, the gas-liquid exchange immediately begins.

As described above, regardless of the ink consumption stage in which the ink reservoir 50 is exchanged, it is assured that a proper amount of negative pressure is generated to reliably deliver ink.

The ink container in accordance with the present invention is capable of absorbing the minute fluctuation in the negative pressure by the function of the ink storing portion 53. In addition, in the case of the structure in accordance with the present invention, even in a situation in which air is contained in the ink storing portion 53, for example, in the second stage of ink delivery, ambient changes can be dealt with by a problem solving method different from any of the prior methods.

Next, referring to FIGS. 18–21, and FIG. 22, the mechanism in the ink container illustrated in FIG. 1, which stabilizes the state of retention will be described.

FIGS. 18–21 are schematic sectional drawings of the ink container in accordance with the present invention, and depict the functions of the portion of the negative pressure generating member 13, above the atmospheric air introduction groove 58, as a buffering absorbent member, and the buffering function of the ink storing portion 53. In these drawings, the sequential changes which occur in the ink container as the air within the ink storing portion 53 expands due to the drop in the atmospheric pressure and/or temperature increase when the ink container is in the state depicted in FIG. 5 (during the gas-liquid exchange period), are depicted in the order of the drawings. In these drawings, (a) is a sectional view correspondent to FIGS. 1, (*b*), and (*b*) is a sectional view of the ink reservoir at the same plane as the plane A—A in FIG. 1, (*b*).

As the air in the ink storing portion 53 expands due to the drop in the atmospheric pressure (or increase in temperature), pressure is applied to the walls (1) and liquid surfaces (2) as shown in FIGS. 9, (*a*) and (*b*). As a result, the internal volume of the ink storing portion 53 increases, and at the same time, a portion of the ink in the ink storing portion 53 flows into the negative pressure generating member holding chamber 10 side through the gas-liquid exchange passage 59*a*. Since the internal volume of the ink storing portion 53 increases, the amount of the ink which flows into the negative pressure generating member holding chamber 10 (amount correspondent to the distance of the rising of the liquid level in the negative pressure generating member, illustrated in FIG. 20, by a referential character (3)), is substantially smaller compared to an ink container with an inflexible ink storing portion.

In this situation, when this pressure change, which allows the internal volume of the ink storing portion 53 to increase, by easing the negative pressure in the ink storing portion 53, is sudden, the amount of the ink which initially flows out through the gas-liquid exchange passage 59*a*, is dominantly affected by the resistance of the walls of the inner shell 54 of the ink reservoir 50 against easing their inward deformation, and the resistance against forcing the ink to move into the negative pressure generating member 13 so that the ink is absorbed by the negative pressure generating member 13.

Figure 18:
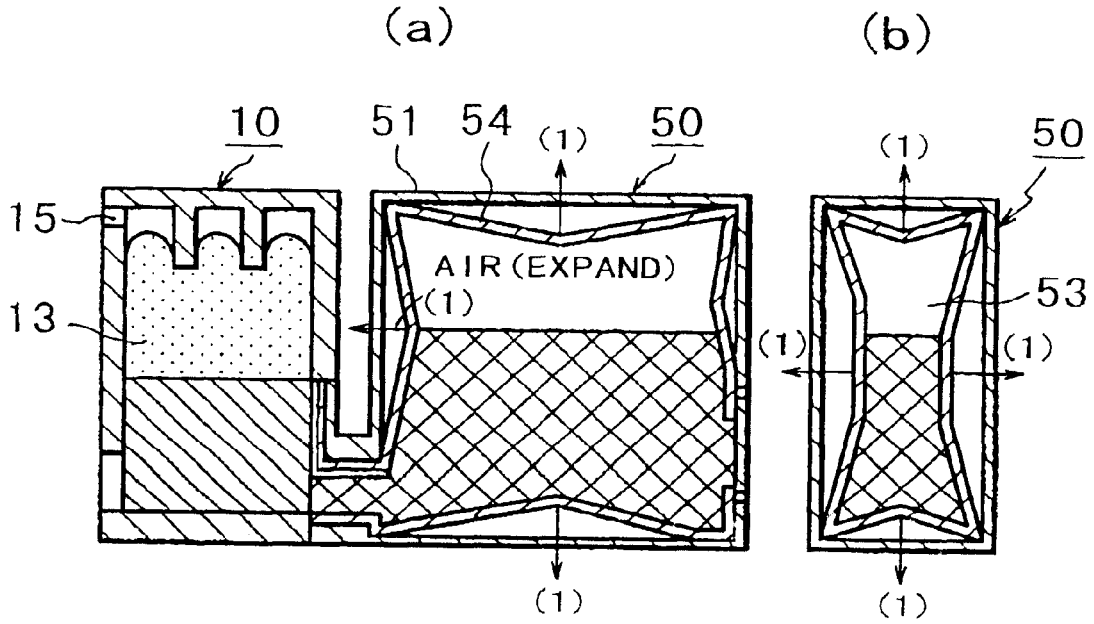
FIG. 18 is a sectional view of the ink container illustrated in FIG. 1, which describes a part of the mechanism for stabilizing the state of ink retention when the ambient condition changes.
Figure 19:
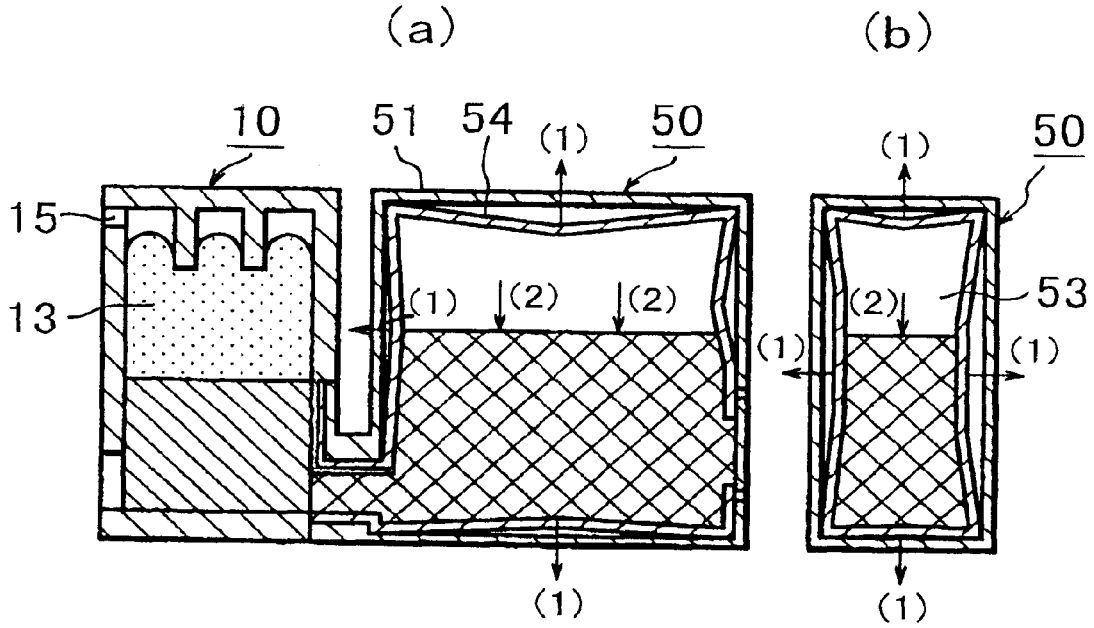
FIG. 19 is a sectional view of the ink container illustrated in FIG. 1, which describes another part of the mechanism for stabilizing the state of ink retention when the ambient condition changes.

In particular, in the case of this structure, the flow resistance of the negative pressure generating member 13 is greater than the resistance to the restoration of the initial state of the ink storing portion 53. Therefore, as the air expands, the internal volume of the ink storing portion 53 increases as shown in FIGS. 18, (*a*) and (*b*). If the theoretical increase in the internal volume which will be caused by the air expansion is greater than the actually tolerable increase in the internal volume, the ink is forced to flow into the negative pressure generating member holding chamber 10 from the ink storing portion 53 through the gas-liquid exchange passage 59*a*. In other words, the walls of the ink storing portion 53 function as the buffer against the ambient changes. Therefore, the ink movement within the negative pressure generating member 13 is eased, and as a result, the negative pressure at the ink delivery port stabilizes.

Figure 20:
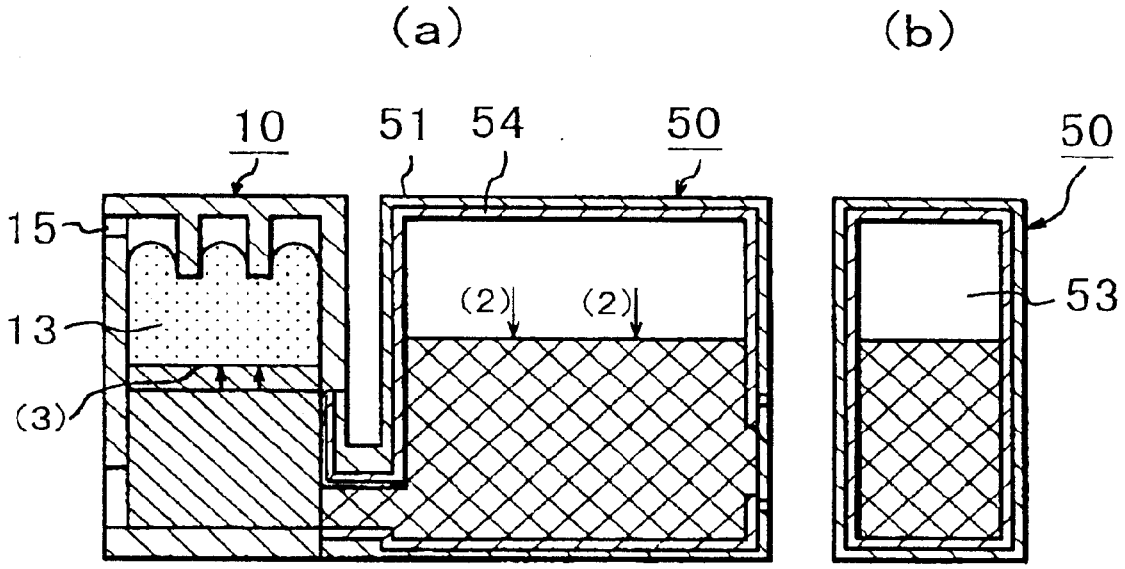
FIG. 20 is a sectional view of the ink container illustrated in FIG. 1, which describes another part of the mechanism for stabilizing the state of ink retention when the ambient condition changes.

In this embodiment, the ink which flows into the negative pressure generating member holding chamber 10 is retained by the negative pressure generating member 13. In this case, the amount of the ink in the negative pressure generating member holding chamber 10 temporarily increases, which causes the position of the gas-liquid interface to rise, as depicted in FIGS. 20, (*a*) and (*b*). Therefore, the internal pressure temporarily turns slightly positive as at the beginning of the usage, which is different from when the internal pressure is stable. However, the effects of this situation upon the ejection characteristics of a liquid jet recording means such as a recording head is small enough to cause no practical problem. Then, as the atmospheric pressure returns to the level prior to the pressure drop (returns to single unit of the atmospheric pressure), the ink which has been retained in the negative pressure generating member 13 after leaking into the negative pressure generating member holding chamber 10, returns to the ink storing portion 53, and at the same time, the ink storing portion 53 restores the previous volume.

Figure 21:
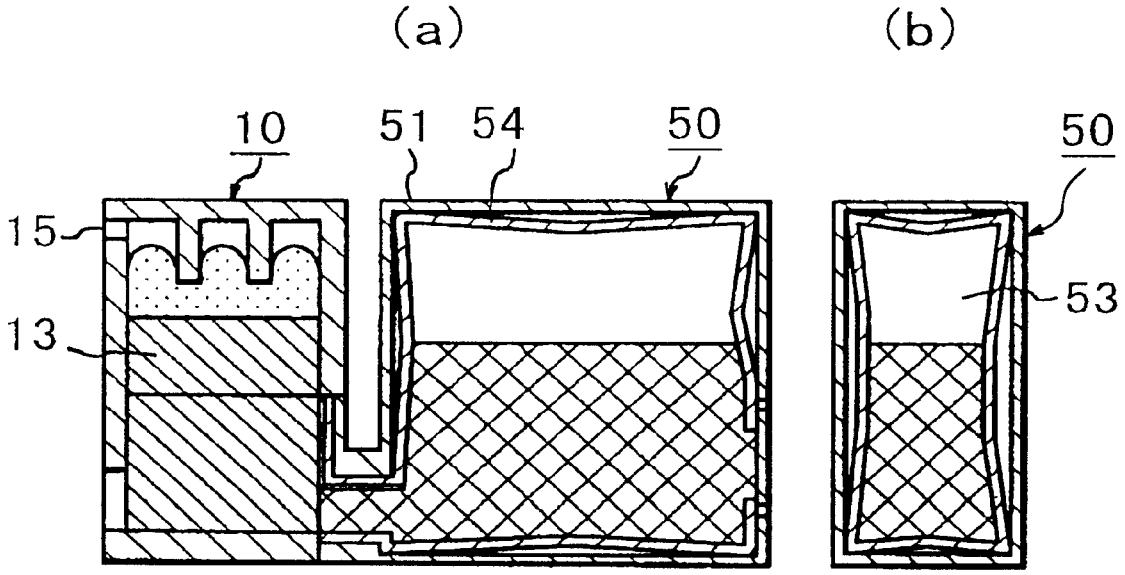
FIG. 21 is a sectional view of the ink container illustrated in FIG. 1, which describes another part of the mechanism for stabilizing the state of ink retention when the ambient condition changes.

Next, referring to FIG. 22, the process which occurs to change the unstable state of the ink container created by the change in the atmospheric pressure, into the stable state illustrated in FIGS. 21, (*a*) and (*b*) will be described.

This process is characterized in that the position of the interface between the ink retained in the negative pressure generating member, and the air in the negative pressure generating member holding chamber, changes in response to not only the amount of the ink delivered from the ink storing portion 53, but also the change in the volume of the ink storing portion itself.

The relationship between the amount of the ink absorbed by the negative pressure generating member 13, and the ink reservoir 50, is as follows. That is, the internal volume of the negative pressure generating member holding chamber 10 is determined in consideration of the prevention of the ink leak from the air vent 15 or the like which occurs at the time of the aforementioned ambient pressure drop and/or temperature change. More specifically, the maximum amount of ink which must be absorbed by the negative pressure generating member 13 is determined in consideration of the amount of the ink forced out of the ink reservoir 50 under the worst condition, and the amount of the ink which is retained by the negative pressure generating member 13 during the ink delivery virtually exclusively from the ink reservoir, and then, the size of the negative pressure generating member 13 is determined based on the thus determined maximum amount of the ink which must be absorbed by the negative pressure generating member 13. Then, the negative pressure generating member holding chamber 10 is provided with an internal volume sufficient to accommodate the negative pressure generating member 13 with the thus determined size.

Figure 22:
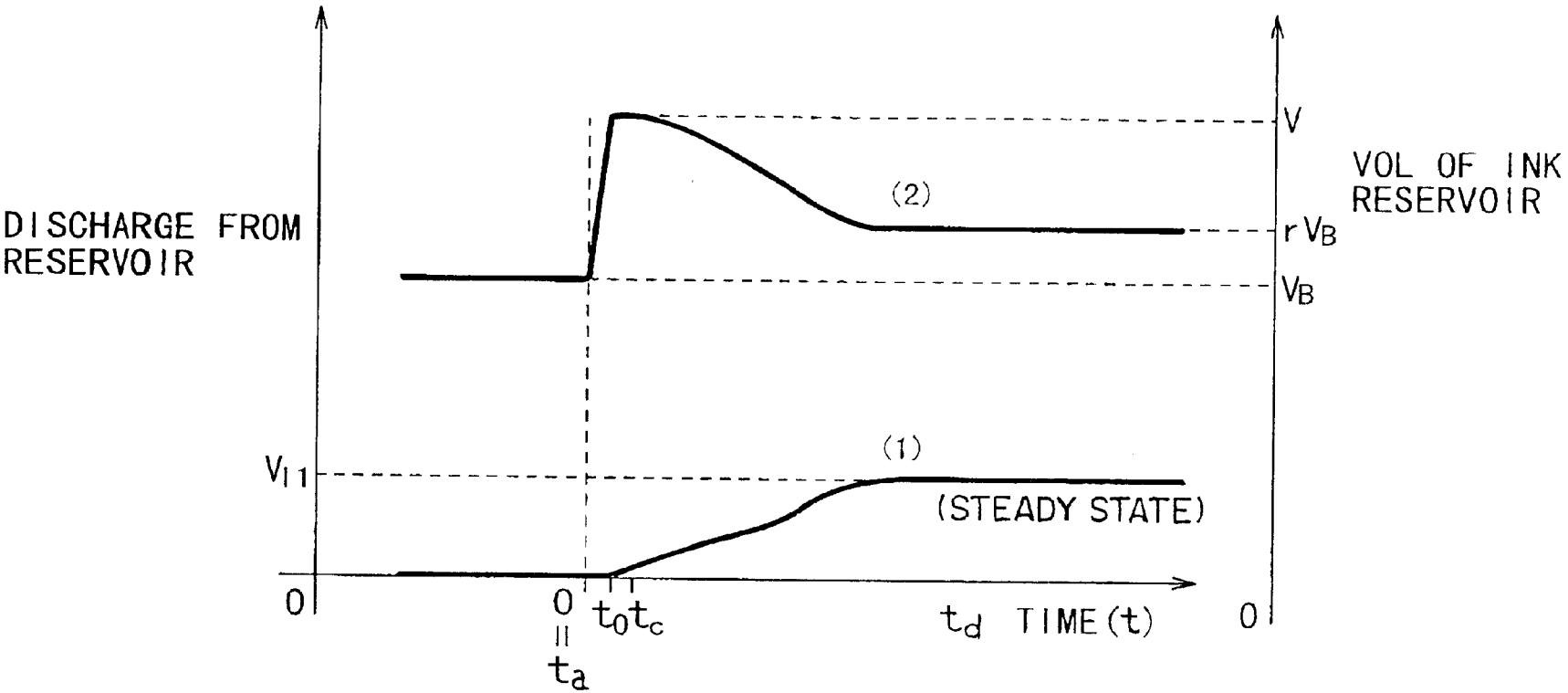
FIG. 22 is a graph which describes the changes occurring, with the elapse of time, to the amount of the ink delivery from the ink storing portion, and the volume of the ink storing portion, when the ambient condition, that is, the ambient pressure, of the ink container illustrated in FIG. 1 is changed from one unit of pressure to a pressure level of P ($0<P<1$).

FIG. 22 is a graph which shows the changes in the rate of ink delivery from the ink storing portion, and the volume of the ink storing portion, after the change in the ambience of the ink container; more specifically, how the rate of ink delivery from the ink storing portion, and the volume of the ink storing portion, change with elapsed time when the atmospheric pressure drops from single unit of the atmospheric pressure to P ($0<P<1$) at time t. In FIG. 22, the axis of abscissas stands for time (t), and the axis of ordinates stands for the amount of the ink delivery from the ink storing portion, and the volume of the ink storing portion. The change in the amount of the ink delivery with the elapsed time is represented by a solid line (1), and the change in the volume of the ink storing portion with the elapsed time is represented by a solid line (2)

Times $t_a$, $t_b$, $t_c$, and $t_d$ in FIG. 22 correspond to the states of ink container depicted in FIGS. 18, 19, 20, and 21.

Referring to FIG. 22, the expansion caused by the sudden change in the ambience is mainly dealt with by the ink reservoir 50 before the negative pressure balance between the negative pressure generating member holding chamber 10 and ink reservoir 50 finally stabilizes. Therefore, the timing of ink delivery from the ink reservoir 50 into the negative pressure generating member holding chamber 10 caused by the sudden change in the ambience of the ink container is delayed.

Thus, it is possible to provide an ink delivery system which is tolerant of the expansion of the gas introduced by gas-liquid exchange, that is, capable of restoring a proper amount of negative pressure while the ink reservoir 50 is in action, under various conditions of usage, and therefore, is capable of reliably delivering ink regardless of the ambient condition.

In the case of an ink delivery system in accordance with the present invention, the material for the negative pressure generating member 13 and ink storing portion 53 is optional. Also, the volumetric ratio between the negative pressure generating member holding chamber 10 and ink reservoir 50 is optional; it may be selected as appropriate. For example, even an ink container with the aforementioned ratio of 1:2 had no problem in practical usage. If the buffering effect of the ink reservoir 50 is of particular concern, all that is necessary is to increase the amount of the deformation allowed for the ink storing portion 53 within the limit of its elastic deformation.

In order to enhance the aforementioned buffering function of the ink storing portion 53, it is desired that the amount of the air present in the ink storing portion 53 when the deformation of the ink storing portion 53 is relatively small is small, in other words, the amount of the air present in the ink storing portion 53 prior to the gas-liquid exchange stage after the connection is as small as possible.

Up to this point, the gist of the present invention was described with reference to the first embodiment of the present invention. Next, other embodiments of the present invention will be described. Needless to say, the components in the first embodiment, and the components in the following embodiments, may be employed in combination when possible.

(Embodiment 2)

Figure 23:
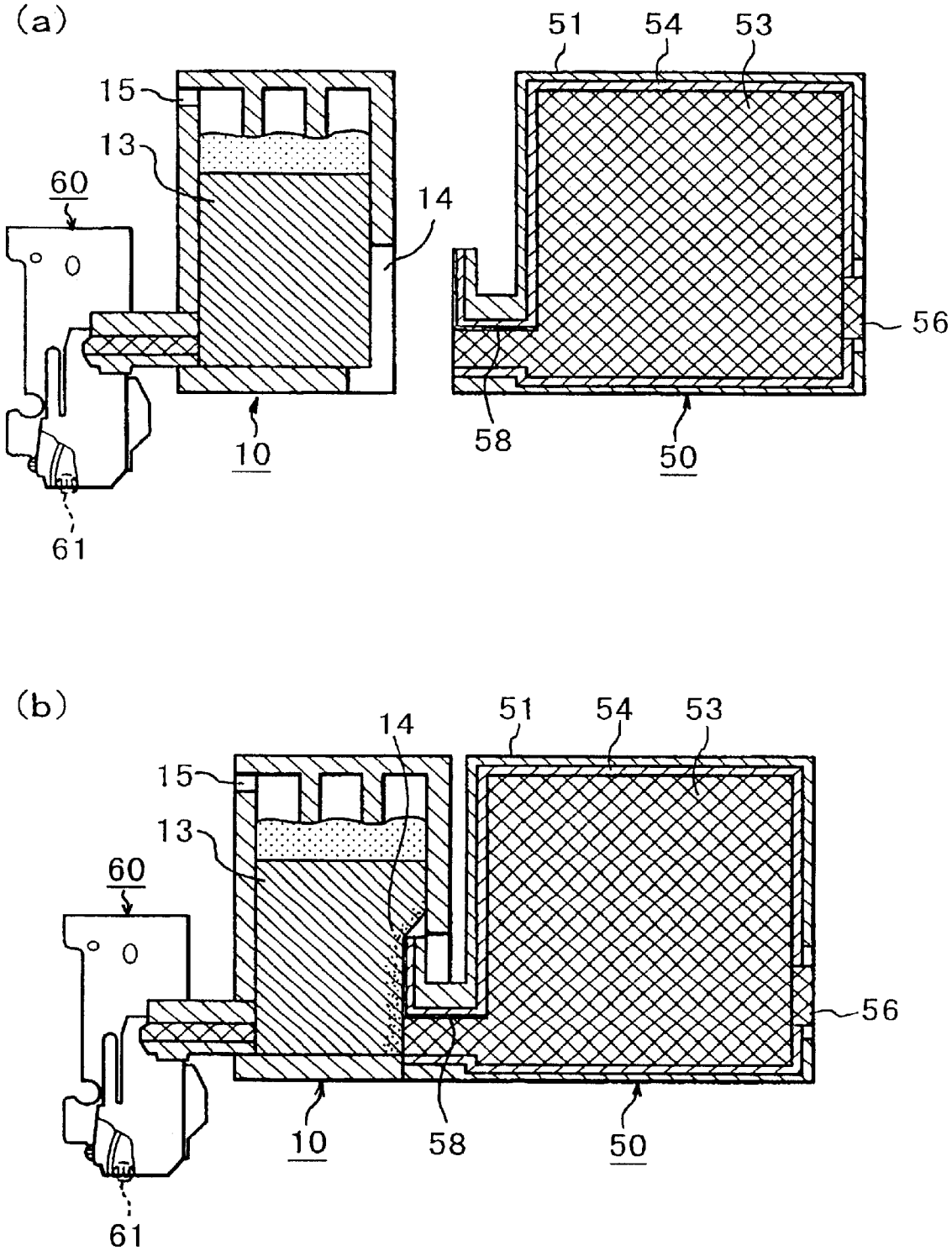
FIG. 23 is a sectional view of the ink container in the third embodiment of the present invention, compatible with the liquid delivery system in accordance with the present invention, and describes the general structure thereof: (a) is a sectional view prior to the connection of the ink reservoir to the negative pressure generating member holding chamber, and (b) is a sectional view after the connection.

FIG. 23 is a schematic sectional view of the ink container in the second embodiment of the present invention, which is compatible with a liquid delivery system in accordance with the present invention. In the drawing, (a) and (b) are sectional views of the ink container before and after the connection of the ink reservoir to the negative pressure generating member holding chamber, respectively.

This embodiment is different from the first one in that the ink container is structured so that the portion of the negative pressure generating member 13, adjacent to the interface portion 14 between the negative pressure generating member holding chamber 10 and ink reservoir 50, is compressed when the ink reservoir 50 is connected to the negative pressure generating member holding chamber 10. Otherwise, this embodiment is the same in structure as the first embodiment.

With the provision of the above described structure, the negative pressure generating member 13 remains compressed adjacent to the interface portion 14 after the connection of the ink reservoir. Therefore, the ink delivery from the ink storing portion 53 into the negative pressure generating member 13 is more stable. Further, ink is smoothly supplied from the ink storing portion 53 into the negative pressure generating member 13 at the time of ink reservoir exchange.

(Embodiment 3)

Figure 24:
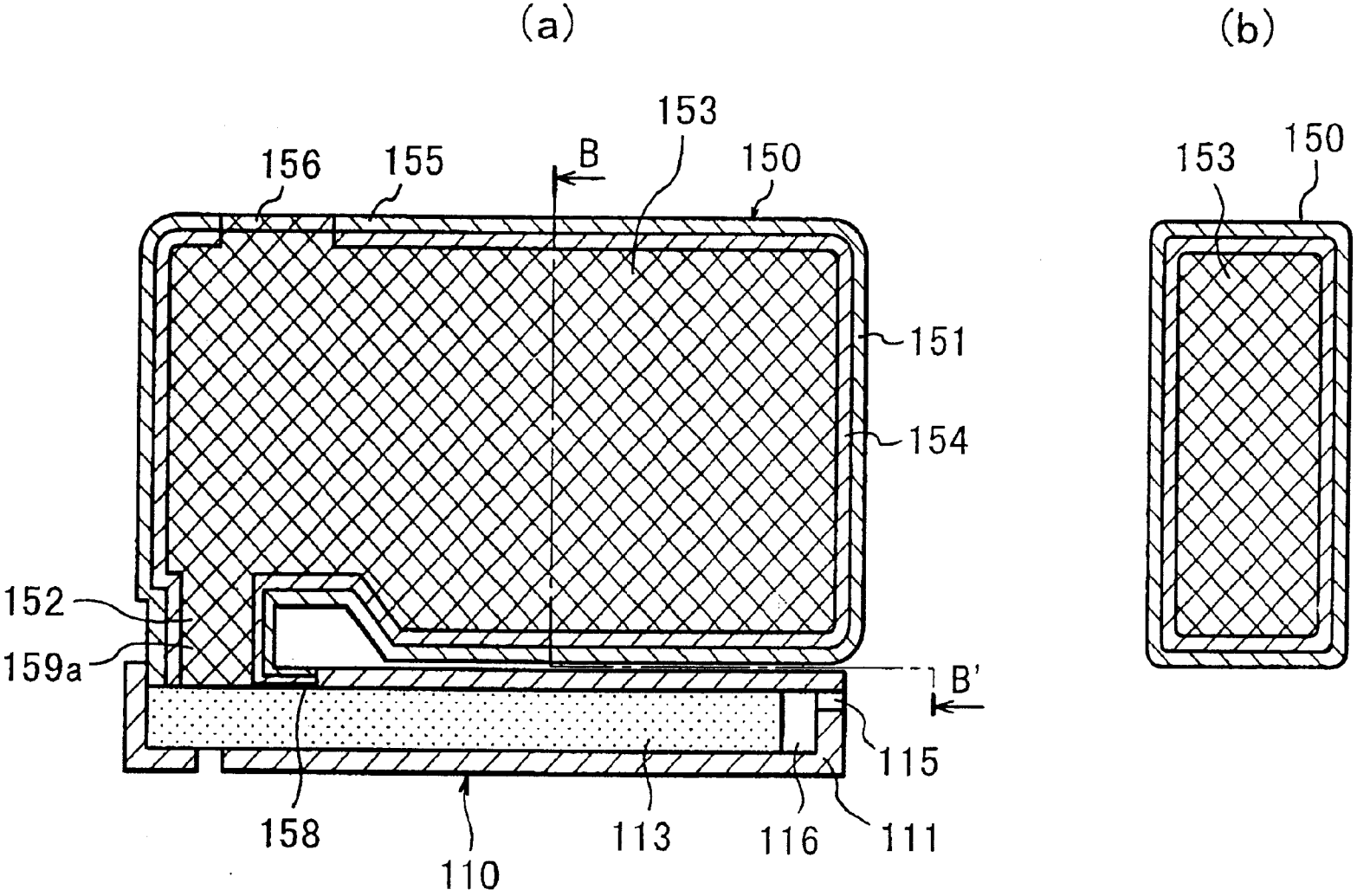
FIG. 24 is a sectional view of the ink container in the third embodiment of the present invention, compatible with the liquid delivery system in accordance with the present invention, and describes the general structure thereof: (a) is a sectional view of the ink container in which the ink reservoir is connected to the negative pressure generating member holding chamber, and (b) is a sectional view of the ink container at a plane indicated by a line B—B in (a).

FIG. 24 is a schematic sectional view of the ink container in the third embodiment of the present invention, which is compatible with a liquid delivery system in accordance with the present invention.

This embodiment is different from the first embodiment in that the ink reservoir 150 is positioned straight above the negative pressure generating member holding chamber 110. Otherwise, it is the same as the first embodiment. In other words, the negative pressure generating member holding chamber 110 comprises a shell 111, a negative pressure generating member 113 contained in the shell, an ink delivery port 112, an air vent 115, a buffer portion 116, and an outside air introduction groove 117, and the ink reservoir 150 comprises an outer shell 151, an inner shell 154, the shape of which matches the internal contour of the outer shell 151, and the internal space of which constitutes an ink storing portion 153, an air vent 155, a pinch-off portion 156, and an ink delivery port 152.

(Embodiment 4)

Figure 25:
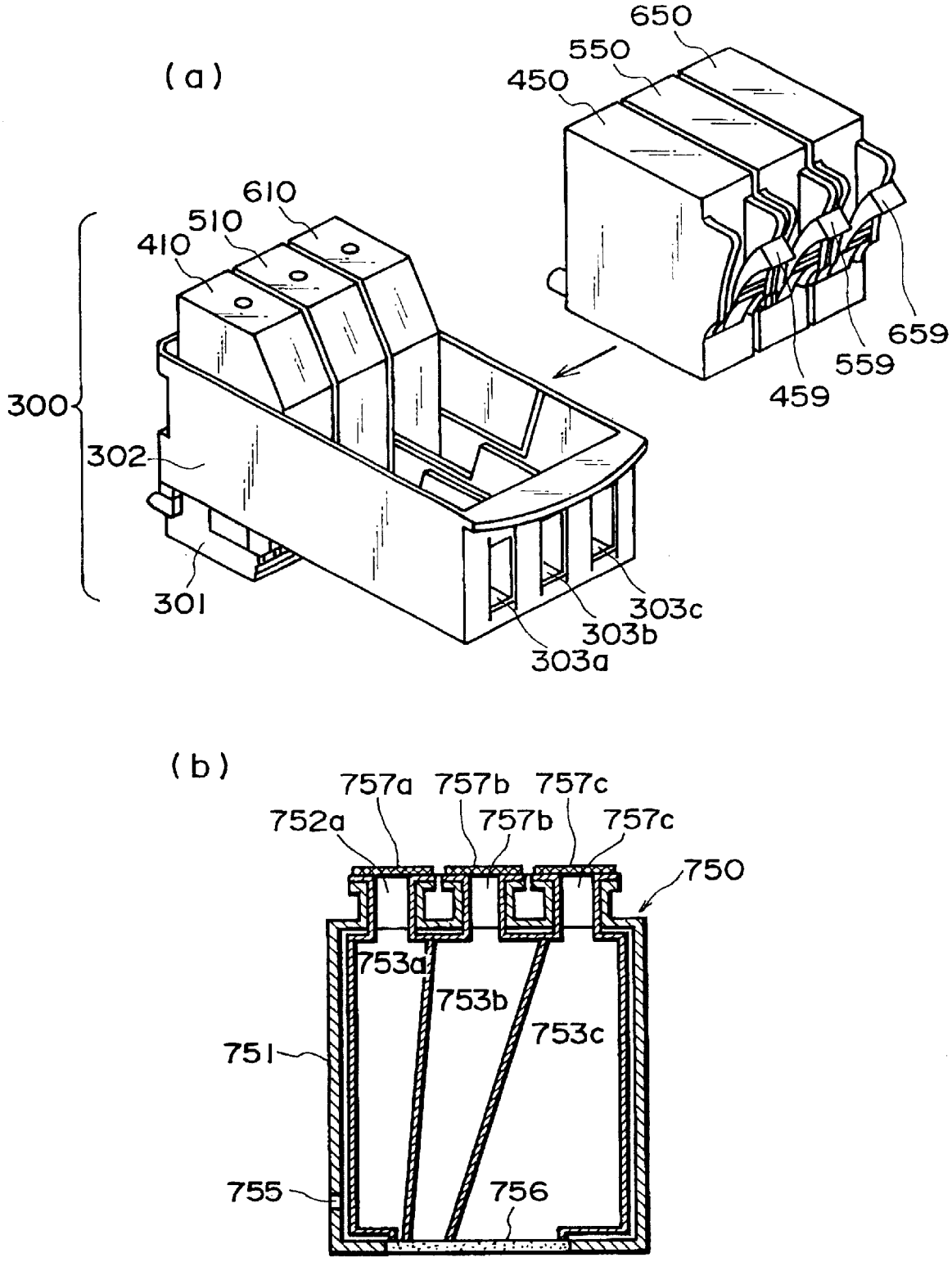
FIG. 25 is a sectional view of the ink container in the fourth embodiment of the present invention, compatible with the liquid delivery system in accordance with the present invention, and depicts the general structure thereof: (a) is a perspective view, and (b) is a sectional view.
Figure 26:
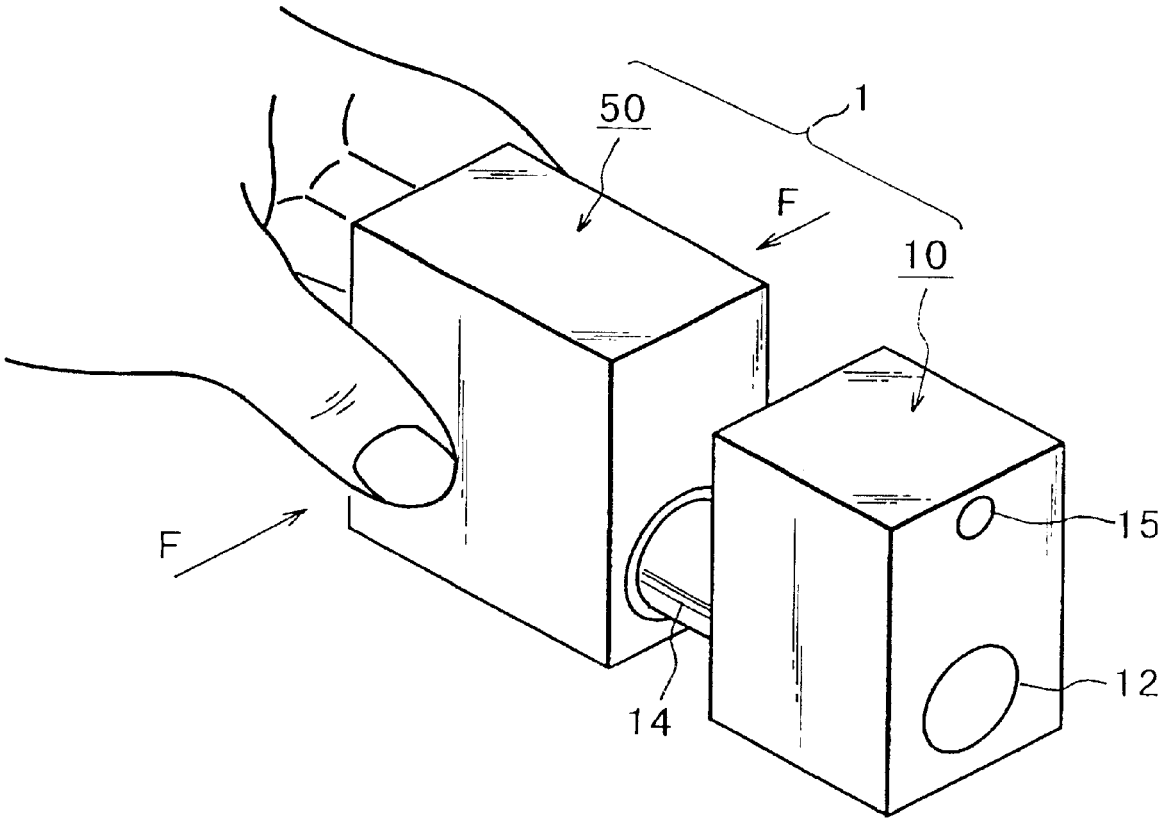
FIG. 26 is a perspective view of the ink container in accordance with present invention, and one example of positive pressure based performance recovery process for ink flow cutoff.

FIG. 25 is a schematic sectional view of the ink container in the fourth embodiment of the present invention, which is compatible with a liquid delivery system in accordance with the present invention. In the drawing, (a) and (b) are perspective and sectional views of the ink container, respectively.

In this embodiment, a head cartridge 300 integrally comprises a liquid ejecting portion 301 capable of ejecting plural choices of liquid different in color (in this embodiment, three colors: yellow, magenta, and cyan), and three negative pressure generating member holding chambers 410, 510, and 610, which are different in the color of the liquid contained therein. To this head cartridge 300, ink reservoirs 450, 550, and 650 are removably connected.

In order to assure that each ink reservoir is connected to the correct negative pressure generating member holding chamber, the head cartridge 300 is provided with a holder portion 302, which partially covers the exterior surfaces of the ink reservoir; the ink reservoirs are provided with latch levers 459, 559, and 659 with an engagement pawl; and the guiding member is provided with engagement holes 303*a*, 303*b*, and 303*c* in which the correspondent engagement pawls engage, so that the ink reservoirs remain properly connected. The ink reservoirs 450, 550, and 650 are virtually the same in shape. Therefore, identification labels (unillustrated) may be provided to prevent an installation error. Obviously, three ink reservoir compartments of the holder may be differentiated in shape as a part of the mechanism for preventing the installation error. In this case, the ink reservoirs may be differentiated in volume, according to the frequency of usage of each color ink reservoir.

This embodiment may be modified so that the plurality of negative pressure generating member holding chambers 410, 510 and 610 can be individually separated from the liquid ejecting portion. It is needless to say that the color of the liquid stored in each ink reservoir may be different from the aforementioned ones, and also the number and combination of ink reservoirs are optional.

Further, in this embodiment, the ink reservoirs are separable from each other. However, they may be inseparably integrated.

An example of an ink reservoir 750 which comprises a plurality of inseparable sub-containers is shown in FIG. 4, (*b*), which is a sectional view of the ink container. The ink reservoir 750 is provided with ink storing portions 753*a*, 753*b*, and 753*c* which are provided with ink delivery ports 752*a*, 752*b*, and 752*c*, which are sealed with sealing members 757*a*, 757*b*, and 757*c*, correspondingly. The ink storing portions 753*a*, 753*b*, and 753*c* correspond to the negative pressure generating member holding chambers 410, 510, and 610, and can be connected thereto by the ink delivery ports 752*a*, 752*b*, and 752*c*. The ink reservoir 750 illustrated in FIG. 25, (*b*) has a plurality of ink storing portions different in size; the ink storing portions are differentiated in internal volume to match the frequency of usage of the liquid contained therein. It should be noted that inseparably integrating the ink reservoirs as in this modification is also effective to prevent the ink reservoir installation error.

(Miscellaneous Embodiments)

In the preceding sections, some of the modifications of the first embodiment were described. Next, miscellaneous modifications of the preceding embodiments will be described, which are compatible with the preceding embodiments unless noted otherwise.

<Structure of Negative Pressure Generating Member Holding Chamber>

First, the descriptions of the structure of the negative pressure generating member holding chamber in the preceding embodiments will be supplemented.

As for the material for the negative pressure generating member to be stored in the negative pressure generating member holding chamber (negative pressure generating member container), felted fiber, a thermoformed pack of fiber, or the like may be used in addition to porous material such as polyurethane foam.

In the above descriptions of the preceding embodiments, the gas-liquid exchange passage (junction) was depicted as a tubular passage. However, it may be in any configuration as long as it does not interfere with gas-liquid exchange during the gas-liquid exchange period In the preceding embodiments, the empty space (buffer portion) in the negative pressure generating member was located in the top portion of the negative pressure generating member holding chamber. However, this space may be filled with an additional amount of the material for the negative pressure generating member, which does not normally retain liquid. With the presence of the additional volume of the negative pressure generating member material in the buffer space, the ink which flows into the negative pressure generating member holding chamber at the time of the aforementioned change in ambience can be held in this portion of the negative pressure generating member.

<Structure of Ink Reservoir>

Next, an additional description will be made of the structures of the ink reservoirs in the preceding embodiments.

In the case of an ink container, in which the ink reservoir is separable from the negative pressure generating member holding chamber, the portion of the ink reservoir, at which the ink reservoir is connected to the negative pressure generating member holding chamber, is provided with a sealing member as a member for preventing liquid and/or air from leaking from the joint portion between the two chambers at the time of the connection, and also for preventing the ink within the ink storing portion from leaking out prior to the connection.

The ink reservoirs in the preceding embodiments are manufactured by direct blow molding. More specifically, the outer shell and inner shell (ink storing portion) of the ink reservoir, which are separable from each other, are formed by uniformly expanding a pair of cylindrical parisons against a mold with a more or less polygonal internal space by air blow. These ink reservoirs may be replaced with ink reservoirs which comprise a flexible pouch, and a metallic spring or the like placed in the pouch to generate negative pressure in response to ink delivery.

However, blow molding is advantageous in that use of blow molding makes it easier not only to manufacture an inner shell, that is, the wall of the ink storing portion, the shape of which is the same as, or similar to, the shape of the outer shell, but also to change the choice and/or thickness of the material for the wall of the ink storing portion to produce a proper amount of negative pressure. Further, using thermoplastic resin as the material for the inner and outer shells makes it possible to provide an easily recyclable ink reservoir.

At this point, the description given above as to the structure of the "outer shell" in each of the preceding embodiments, and the particular features of the "outer shell", which affect the "inner shell" will be supplemented.

In each of the preceding embodiments, the ink reservoir is manufactured by blow molding. Therefore, the structure of the inner shell is such that the thickness of each wall is less at the corner portions than at the center portion of each wall. This is also true of the outer shell. The inner shell is placed in the outer shell in such a way that each wall of the inner shell is laid upon the inward surface of the correspondent wall of the outer shell.

In other words, the outward surface of each of the inner shell interfaces with the inward surface of the correspondent wall of the outer shell. As a result, the walls of the inner shell, that is, the walls of the ink storing portion, slightly bulge inward, since the thickness of the walls of the outer shell gradually increase from the corners toward the center as described above. Further, since the thickness of each wall of the inner shell also increases from the corners toward the center, the inward surface of each wall of the inner shell further bulges inward of the ink storing portion. The effects of this structural arrangement are most prominently displayed by the walls with the largest size. Therefore, as far as the present invention is concerned, it is not necessary that all the walls of the inner and outer shells are structured as described above. In other words, all that is necessary is that at least the wall with the largest size is provided with this structural arrangement. The distance the inward surface of the wall of the inner shell bulges inward does not need to exceed 2 mm, and the distance the outward surface of the wall of the inner shell bulges inward does not need to exceed 1 mm. In the case of the smaller size wall, these distances may fall within the range of measurement error. However, this structural arrangement, which makes the inward surface of the ink storing portion inwardly bulge, is one of the factors which establishes the order in which each of the walls of the ink container in the form of a virtually polygonal prism, deforms. In other words, this feature is one of the preferable aspects of the present invention.

Next, the description of the structure of the outer shell will be supplemented. In the preceding description of the outer shell, regulating the deformation of the corner portions of the inner shell was listed as one of its functions. All that is necessary for the outer shell to be enabled to perform this function is that the outer shell is structured so that it is not deformed by the deformation of the inner shell, and that it surrounds all the corner portions of the inner shell (outer shell functions as a corner covering member). Therefore, the outer shell may be in such a form that comprises corner portions with a panel structure, and metallic rods or the like which connect these corner portions, in addition to being in the aforementioned fully wall clad form. Further, the outer shell may be mesh structured.

In the case of an exchangeable ink reservoir, ink flow is sometimes cut off for various reasons between the adjacency of the gas-liquid exchange passage of the negative pressure generating member and the adjacency of the ink delivery port, when the ink reservoir is exchanged. If this happens, the ink flow can be easily restored simply by manually and temporarily squeezing the elastically deformable outer shell, along with the inner shell, to force the ink within the ink reservoir into the negative pressure generating member holding chamber. This recovery process based on pressure application can be automatically, rather than manually, carried out by providing a recording apparatus, which will be described later, with a pressure based ink flow recovering means. In the case of an ink reservoir with a partially exposed inner shell, the portion to which pressure is applied may be only the exposed portion of the inner shell.

In the preceding embodiments, the ink storing portion is virtually in the form of a polygonal prism. However, the shape of the ink storing portion does not need to be limited to a polygonal prism. In other words, from the standpoint of accomplishing the first object of the present invention, the ink storing portion may be in any shape as long as the shape allows the ink storing portion to deform, in response to outward delivery of the ink, sufficiently to provide the ink storing portion with negative pressure. As for the material for the outer shell, it may be plastic, metal, cardboard, or the like.

In order to provide the ink storing portion with the aforementioned buffering function, the ink storing portion must be capable of elastic deformation, so that it restores the pre-deformation shape as the substance stored therein expands. In other words, the ink storing portion is required to deform within a range in which the deformation of the ink storing portion is reversible. It is true that, occasionally, the rate at which the negative pressure is fluctuated by the deformation caused by the outward delivery of ink suddenly changes (for example, in the case of deformed portions coming into contact with each other). Therefore, the configuration of the ink storing portion is desired to be such that, even if the extent of the deformation is within the reversible range, the first stage of ink delivery is completed, that is, the ink storing portion is readied for the second stage of ink delivery, before the situation in which the aforementioned sudden change in negative pressure might occur is created.

The material for the liquid storing container in accordance with the present invention may be any material as long as it allows the inner and outer shells to separate from each other. Further, a plurality of materials may be used to make the walls of the inner and outer shell laminar. The ink reservoir structure in accordance with the present invention makes it possible to employ an inner shell which has walls with higher elasticity compared to the reservoir structure which comprises only the ink reservoir which doubles as the negative pressure generating member holding container. In consideration of the effects of the reservoir material upon ink or the like which is contained in the reservoir, polyethylene, polypropylene, and the like, for example, are preferable.

Next, a method for forming the atmospheric air introduction groove will be described. If a direct blow molding method is employed to manufacture an ink reservoir, a groove is formed on the inward side of the pinch-off portion. This groove can be used as the atmospheric air introduction groove.

Preferably, the atmospheric air introduction groove should be molded in during the blow molding process, so that the length and depth of the atmospheric air introduction groove can be regulated.

<Ink Container>

In the preceding embodiments, the ink reservoir is made removably connectable to the negative pressure generating member holding chamber. Therefore, the ink reservoir is desired to be provided with a sealing member such as an O-ring so that the joint between the two chambers is sealed by the sealing member to prevent ink from leaking out of the joint.

<Liquid Delivery Action and Ink Delivery System>

Next, the description of the liquid delivery action and ink delivery system will be supplemented.

The ink container (ink delivery system) in each of the preceding embodiments goes through four stages: the pre-usage stage in which no connection has been established between the ink reservoir and negative pressure generating member holding chamber; the initial stage of ink delivery immediately after the connection; the first stage of ink delivery; and the second stage of ink delivery.

Obviously, the ink container in each of these embodiments can be modified. As the first of such modifications, the ink container may be modified so that its ink delivery process does not include the gas-liquid exchange stage, i.e., the second stage of ink delivery. In the case of this type of modification, the ink in the ink storing portion is consumed without introducing the outside air into the ink storing portion. Therefore, the only factor which must be taken into consideration to regulate the internal volume of the liquid storing container is the volume of the air introduced into the ink reservoir at the time of the connection. In other words, this modification has merit in that the ink container is enabled to deal with ambient changes, in spite of the relaxed regulation over the internal volume of the ink reservoir; the modified structure can accomplish the first object of the present invention. However, if the space utilization efficiency for the ink storing portion is taken into consideration, the structure, such as in each of the preceding embodiments, which provides the ink container with the gas-liquid exchange stage which follows the first stage of ink delivery, is superior to this modified structure.

The second modification deals with such a situation that the liquid level in the negative pressure generating member holding chamber prior to the connection is higher than the position of the gas-liquid interface, which sometimes occurs when the ink container is in the state depicted in FIG. 2. More specifically, among the ink movements which occur to ready the ink container for the initial ink delivery, and were described with reference to FIG. 3, the unidirectional ink movement into the negative pressure generating member holding chamber caused by the capillary force, does not occur.

The third modification deals with a situation in which the rate at which ink is consumed by a recording head is extremely high. More specifically, when the ink consumption rate of a recording head is extremely high, the negative pressure is not always balanced between the two chambers. Instead, the ink in the negative pressure generating member holding chamber is primarily consumed until the amount of the difference between the negative pressures in the two chambers exceeds a predetermined value, and as the amount of the difference exceeds the predetermined value, the ink in the ink reservoir moves into the negative pressure generating member holding chamber side.

The aforementioned ink container, the two chambers of which always remain united, is different from the ink container, the two chambers of which are separable, only in that in the case of the former, the state of the ink container at the beginning of usage is the same as the state of the ink container at the end of the usage. Otherwise, there is no difference between the former and the latter. Thus, the descriptions given above regarding the effects of the preceding embodiments also apply to these modified versions of the ink container.

<Liquid Jet Recording Apparatus>

Figure 27:
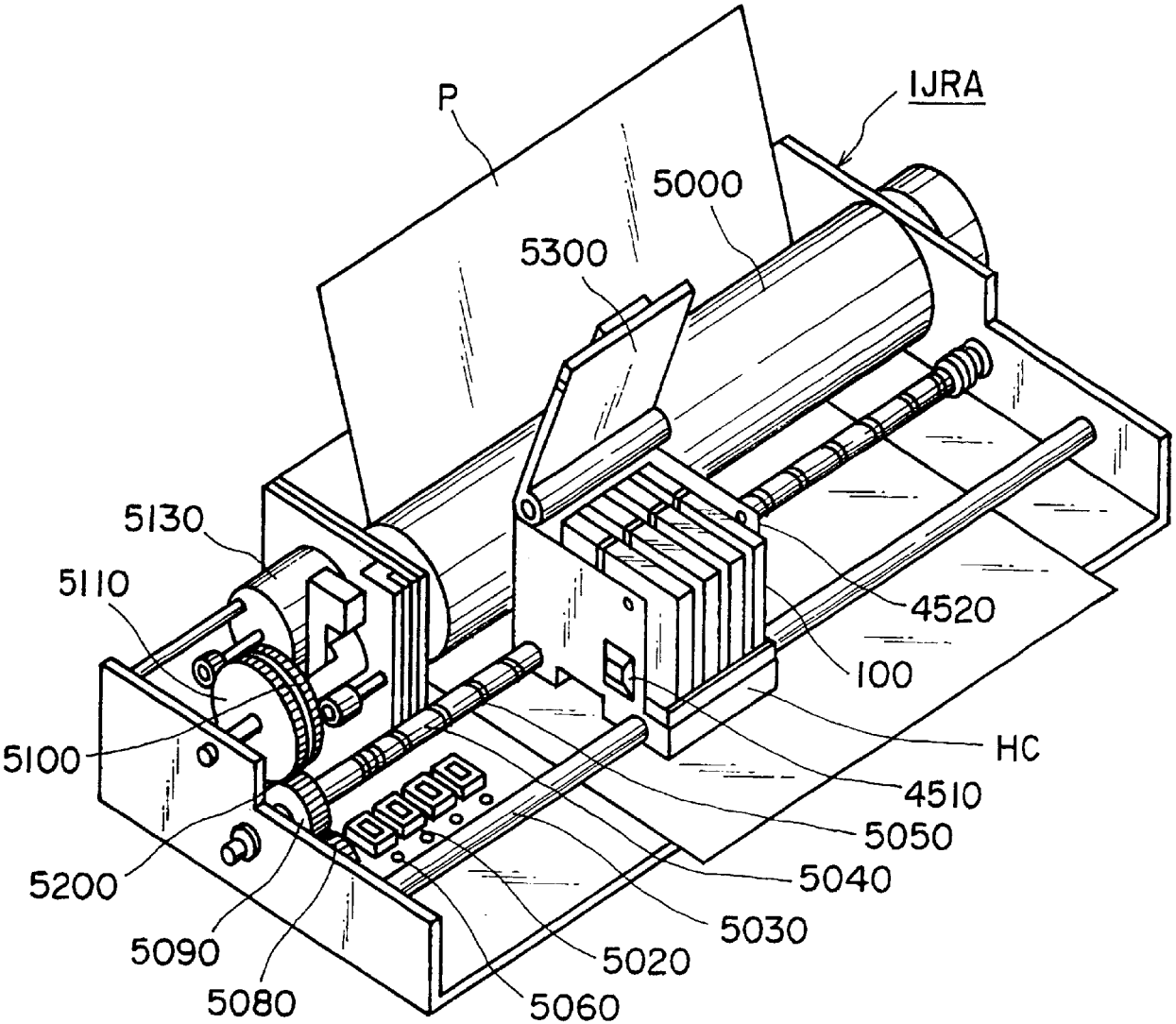
FIG. 27 is a perspective view of the ink jet recording apparatus usable with the liquid delivery system in accordance with the present invention.

Lastly, an ink jet recording apparatus in which the ink container in the first embodiment of the present invention, depicted in FIG. 1, is mounted to record images will be described. FIG. 27 is a perspective view of the ink jet recording apparatus in which the ink container in the first embodiment of the present invention has been mounted, and depicts the general structure thereof.

In FIG. 27, a head unit 4010 and an ink container 100 are supported by a carriage 4520 of the main assembly of the ink jet recording apparatus. More specifically, they are removably attached to the carriage 4520 with the use of an unillustrated positioning means, and a connecting plate 5300 which is rotatively supported by an axis.

The forward and backward rotation of a motor 5130 is transmitted to a lead screw 5040 through driving force transmission gears 5110 and 5090, and rotates the lead screw. The carriage 4520 is provided with a pin (unillustrated) which engages with the spiral groove 5050 of the lead screw 5040. With the provision of the above arrangement, the carriage 4520 is shuttled in the longitudinal direction of the apparatus.

A referential character 5020 designates each of the caps for capping the front surface of the corresponding recording head within the recording unit. The cap 5020 is used to recover the performance of the recording head by suctioning the recording head through the internal passage of the cap, with the use of an unillustrated suctioning means. The cap 5020 is moved by the driving force transmitted through the gear 5080 and the like, to cover the recording head surface in which ejection orifices are present. Adjacent to the caps 5020, a cleaning blade is provided, which is not illustrated. This blade is supported so that it can be moved in the upward or downward direction in the drawing. The blade shape is not limited to a specific one. Needless to say, any of the known cleaning blades can be employed as the cleaning blade for this ink jet recording apparatus in this embodiment.

The apparatus in this embodiment is structured so that these operations of capping, cleaning, and suctioning for performance recovery, are carried out at their appropriate positions by the function of the lead screw 5050 when the carriage 4520 is at the home position. However, other structures are also acceptable as long as they make the these components perform their functions with known timing.

Here, the advantages of mounting an ink container in accordance with the present invention on a carriage which shuttles as described above will be described.

The ink reservoir of the ink container in accordance with the present invention is a deformable component, being therefore enabled to cushion the ink vibration caused by the scanning movement of the carriage, by its deformation. In order to prevent the fluctuation of the negative pressure caused by the scanning movement of the carriage, it is desired that a part or parts of the corner portions of the ink storing portion are not separated from the internal surface of the outer shell, or that the corner portions of the ink storing portion remain close to the internal surface of the outer shell, even if they are separated. Further, in the case of an ink storing portion, such as the one in this embodiment, it is desired to be mounted on the carriage in such a way that the pair of opposing walls with the largest size become perpendicular to the direction of the scanning movement of the carriage. Such an arrangement can enhance the aforementioned ink vibration cushioning effect.

Further, a recording apparatus may be provided with a pressure based performance recovery means for indirectly pressing the inner shell of the ink reservoir through the outer shell of the ink reservoir, as described in the section <Structure of Ink Reservoir>. In the case of such an arrangement, it is recommended that the recording apparatus is provided with: a liquid presence detecting means 5060 which comprises a light emitting means and a light receiving means, and detects the presence (absence) of ink from the state of the reflection of the light projected through the ink reservoir, an ejection failure detecting means (unillustrated) which detects the ejection failure of a recording head, and a controlling means (unillustrated), because, such provision makes it possible to prevent ink flow from being cut off between the adjacency of the gas-liquid exchange passage of the negative pressure generating member and the adjacency of the ink delivery port, provided that an operational sequence such as the one described below is adopted.

The sequence is as follows. First, if the ejection failure of the head nozzles is detected after the ink reservoir is replaced with a fresh one, and the standard performance recovery operation, i.e., the suction based operation, is carried out with the use of the cap 5020, the normal operation is restored by carrying out the pressure based performance recovery operation. Also, if, during the usage of the ink reservoir, the state of "ink presence" is detected by the liquid presence detecting means, and also, the ejection failure of the nozzles of the head correspondent to the ink reservoir in which ink is present is detected by the ejection failure detecting means, but the ejection failure could not be remedied by the standard performance recovery operation, i.e., the suction based operation, the normal operation can be restored by carrying out the positive pressure based performance recovery operation. In either case, it is desired that the recording head portion correspondent to the ink container for which the positive pressure based performance recovery operation is to be carried out is capped to prevent unexpected ink leak from the recording head portion.

The choice of the liquid presence detecting means does not need to be limited to an optical type such as the aforementioned one. Other types such as a dot counting type may be employed, or different types may be employed in combination.

As described above, according to the present invention, the atmospheric air introduction groove for enhancing the gas-liquid exchange is provided as a part of the ink reservoir separable from a negative pressure generating member holding chamber, and therefore, does not malfunction, making it possible to provide a liquid delivery system capable of reliably delivering ink, and a liquid storing container compatible with such a system.

The liquid storing container is provided with a liquid storing portion capable of producing negative pressure by deforming in response to the outward liquid delivery therefrom. Therefore, the liquid storing container is capable of preventing the ink in the ink storing portion from flowing into the negative pressure generating member holding chamber, or is capable of reducing the amount of the ink in the ink storing portion which flows into the negative pressure generating member holding chamber, even if the air introduced into the ink storing portion expands in response to ambient changes. As a result, liquid ejection remains stabilized.

Further, the liquid storing container used for the liquid delivery system in accordance with the present invention is capable of moving the liquid in the liquid storing container into the negative pressure generating member with the use of the capillary force of the negative pressure generating member holding chamber at the time of the installation of the liquid storing portion. Therefore, it is assured that the ink in the liquid storing container becomes available for delivery, regardless of the state of liquid retention in the negative pressure generating member, adjacent to the joint, upon simple installation of the ink storing container.

While the invention has been described with reference to the structures disclosed herein, it is not confined to the details set forth, and this application is intended to cover such modifications or changes as may come within the purposes of the improvements or the scope of the following claims.

What is claimed is:

1. A liquid supplying system comprising a negative pressure producing member accommodating chamber and a liquid accommodating container having a connecting portion for detachably mounting said liquid accommodating container to said negative pressure producing member accommodating chamber, wherein said negative pressure producing member accommodating chamber includes a liquid supply portion for supplying liquid to outside, and a gas vent for gas communication with ambience, said negative pressure producing member accommodating chamber for accommodating a negative pressure producing member for retaining liquid therein, and wherein said liquid accommodating container defines a substantially hermetically sealed space except for liquid and gas communication with said negative pressure producing member accommodating chamber through said connecting portion, and wherein said connecting portion of the liquid accommodating container functions in common both for introduction of gas from said negative pressure producing member accommodating chamber into said liquid accommodating container and for discharge of the liquid from said liquid accommodating container into said negative pressure producing member accommodating chamber, wherein said connecting portion includes an air introducing groove for permitting the introduction of the gas and a liquid discharge passage for permitting the discharge, wherein the air introducing groove has a vertical groove section which, when said liquid accommodating container is mounted to the negative pressure producing member accommodating chamber, is in contact with the negative pressure producing member of the negative pressure producing member accommodating chamber, and wherein the air introducing groove is disposed at an upper part of said connecting portion when said liquid accommodating container is mounted and said liquid supplying system is operating.

2. A system according to claim 1, wherein said liquid accommodating container includes a liquid containing portion containing the liquid, the liquid containing portion being deformable while producing a negative pressure with discharge of the liquid, said liquid accommodating container further including a casing covering the liquid containing portion, and an ambience communication port for introducing the ambience between the casing and said liquid containing portion.

3. A system according to claim 1, wherein said liquid accommodating container includes a liquid discharge portion which is sealed by a sealing member.

4. A system according to claim 3, wherein said sealing member is removed after said liquid accommodating container is mounted to said negative pressure producing member accommodating chamber.

5. A system according to claim 1, wherein a part of said negative pressure producing member is present between said air introducing groove and said gas vent when said liquid accommodating container is mounted to said negative pressure producing member accommodating chamber.

6. A system according to claim 1, wherein said negative pressure producing member accommodating chamber is provided with a groove combined with the air introducing groove.

7. A liquid accommodating container detachably mountable to a negative pressure producing member accommodating chamber which is provided with a liquid supply portion for supplying liquid to outside, a gas vent for gas communication with ambience, and a negative pressure producing member for retaining liquid therein, said liquid accommodating container comprising:

a connecting portion for detachably mounting said liquid accommodating container to said negative pressure producing member accommodating chamber; and a substantially hermetically sealed space except for liquid and gas communication with said negative pressure producing member accommodating chamber through said connecting portion;

wherein said connecting portion includes an air introducing groove for permitting the introduction of the gas and a liquid discharge passage for permitting the discharge, wherein the air introducing groove has a vertical groove section which, when said liquid accommodating container is mounted to the negative pressure producing member accommodating chamber, is in contact with the negative pressure producing member of the negative pressure producing member accommodating chamber, and wherein the air introducing groove is disposed at an upper part of said connecting portion when said liquid accommodating container is mounted.

8. A liquid accommodating container according to claim 7, further comprising a liquid containing portion containing the liquid, the liquid container portion being deformable while producing a negative pressure with discharge of the liquid, said liquid accommodating container further comprising a casing covering the liquid containing portion, and an ambience communication port for introducing the ambience between the casing and said liquid containing portion.

9. A liquid accommodating container according to claim 7, further comprising a liquid discharge portion which is sealed by a sealing member.

10. A liquid accommodating container according to claim 9, wherein said sealing member is removed after said liquid accommodating container is mounted to said negative pressure producing member accommodating chamber.

11. A liquid accommodating container according to claim 7, wherein a part of said negative pressure producing member is present between said air introducing groove and said gas vent when said liquid accommodating container is mounted to said negative pressure producing member accommodating chamber.

12. A liquid accommodating container according to claim 7, wherein said negative pressure producing member accommodating chamber is provided with a groove combined with the air introducing groove.

13. A head cartridge comprising a liquid accommodating container as defined in claim 7, a negative pressure producing member accommodating chamber as defined in claim 7, and a recording head connected to said negative pressure producing member accommodating chamber via the liquid supply portion for discharging the liquid supplied from said negative pressure producing member accommodating chamber to outside.

* * * * *

UNITED STATES PATENT AND TRADEMARK OFFICE

CERTIFICATE OF CORRECTION

PATENT NO. : 6,575,567 B2
DATED : June 10, 2003
INVENTOR(S) : Hidehisa Matsumoto et al.

It is certified that error appears in the above-identified patent and that said Letters Patent is hereby corrected as shown below:

Column 3,
Line 27, “be become” should read -- become --.

Column 6,
Line 37, “present” should read -- the present --.

Column 7,
Line 19, “54,” should read -- 51, --;
Line 24, “liquid” should read -- ink --;
Line 30, “56” should read -- 54 --;
Line 31, “air vent 52” should read -- air vent --.
Line 36, “groove 53” should read -- groove 58 --; and
Line 47, “portion 52,” should read -- port 52 --.

Column 9,
Line 30, “storing” should read -- ink storing --; and
Line 42, “Japanese Patent application No. 200126/1997,” should read -- European Patent Application No. 829,365, --.

Column 10,
Line 9, “wall” should read -- walls --.

Column 11,
Line 18, “flows” should read -- flow --.
Line 54, “shell 51,” should read -- outer shell 51, --; and
Line 62, “head” should read -- head portion --.

Column 12,
Line 42, “head” should read -- head portion --;
Line 47, “storing” should read -- storing portion --.

Column 13,
Line 18, “introduced” should read -- be introduced --; and
Line 33, “only the” should read -- the only --.

Column 15,
Line 32, “pattern” should read -- patterns --.

Column 16,
Line 1, “deforms” should read -- deform --.

Column 18,
Line 57, “ink” should read -- the ink --.

UNITED STATES PATENT AND TRADEMARK OFFICE

CERTIFICATE OF CORRECTION

PATENT NO. : 6,575,567 B2 
DATED : June 10, 2003
INVENTOR(S) : Hidehisa Matsumoto et al.

It is certified that error appears in the above-identified patent and that said Letters Patent is hereby corrected as shown below:

Column 20,
Line 39, “chance” should read -- a chance --.

Column 22,
Line 48, “single” should read -- a single --.

Column 24,
Line 55, “FIG. 4,” should read -- FIG. 25, --.

Column 26,
Line 17, “each” should read -- each wall --.

Column 29,
Line 40, “the these” should read -- these --.

Column 32,
Line 36, “container” should read -- containing --.

Signed and Sealed this

Twenty-eighth Day of October, 2003

JAMES E. ROGAN
*Director of the United States Patent and Trademark Office*